US007216533B2

(12) United States Patent
McGregor et al.

(10) Patent No.: US 7,216,533 B2
(45) Date of Patent: May 15, 2007

(54) METHODS FOR USING A FORMATION TESTER

(75) Inventors: Malcolm D. McGregor, The Woodlands, TX (US); Gregory N. Gilbert, Sugar Land, TX (US); Mark A. Proett, Missouri City, TX (US); James M. Fogal, Houston, TX (US); David Welshans, Damon, TX (US); Glenn C. Gray, Austin, TX (US); Svetozar Simeonov, Houston, TX (US); Laban M. Marsh, Houston, TX (US); Jean Michel Beique, Katy, TX (US); James E. Stone, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/132,475

(22) Filed: May 19, 2005

(65) Prior Publication Data

US 2005/0268709 A1 Dec. 8, 2005

Related U.S. Application Data

(60) Provisional application No. 60/573,423, filed on May 21, 2004.

(51) Int. Cl.
*E21B 21/08* (2006.01)
*E21B 47/06* (2006.01)

(52) U.S. Cl. ..... 73/152.27; 73/152.51

(58) Field of Classification Search ..... 73/152.02, 73/152.51, 152.22, 152.38, 152.46, 152.54, 73/152.27; 166/250.1, 256

See application file for complete search history.

(56) References Cited

U.S. PATENT DOCUMENTS 3,173,485 A 3/1965 Bretzke, Jr. ..... 166/100

(Continued)

FOREIGN PATENT DOCUMENTS

EP 0697501 A2 2/1996

(Continued)

OTHER PUBLICATIONS

Joel L. Hebert: "A Method for Planning and Performing a Pressure Survey to Achieve Desired Accuracy of Pressure Gradient"; 2002 ASME Engineering Technology Conference on Energy; Feb. 4-5, 2002; pp. 1-8; ETCE 2002; American Society of Mechanical Engineers; Houston, Texas, U.S.A.

(Continued)

*Primary Examiner*—Hezron Williams
*Assistant Examiner*—Tamiko Bellamy
(74) *Attorney, Agent, or Firm*—Conley Rose PC

(57) ABSTRACT

A method of testing a downhole formation using a formation tester on a drill string. The formation tester is disposed downhole on a drill string and a formation test is performed by forming a seal between a formation probe assembly and the formation. A drawdown piston then creates a volume within a cylinder to draw formation fluid into the volume through the probe assembly. The pressure of the fluid within the cylinder is monitored. The formation test procedure may then be adjusted. The test procedure may be adjusted to account for the bubble point pressure of the fluid being monitored. The pressure may monitored to verify a proper seal is formed or is being maintained. The test procedure may also be performed by maintaining a substantially constant drawdown rate using a hydraulic threshold or a variable restrictor.

26 Claims, 15 Drawing Sheets

U.S. PATENT DOCUMENTS

| | | | | | |
|---|---|---|---|---|---|
| 3,338,307 | A | | 8/1967 | Redwine | 166/100 |
| 3,356,137 | A | | 12/1967 | Raugust | 166/264 |
| 3,530,933 | A | | 9/1970 | Whitten | 166/100 |
| 3,565,169 | A | | 2/1971 | Bell | 166/100 |
| 3,811,321 | A | | 5/1974 | Urbanosky | 73/152.25 |
| 3,813,936 | A | | 6/1974 | Urbanosky et al. | 73/152.25 |
| 3,858,445 | A | | 1/1975 | Urbanosky | 73/152.24 |
| 3,859,850 | A | | 1/1975 | Whitten et al. | 73/152.24 |
| 3,859,851 | A | | 1/1975 | Urbanosky | 73/152.24 |
| 3,864,970 | A | | 2/1975 | Bell | 73/152.25 |
| 3,924,463 | A | | 12/1975 | Urbanosky | 73/152.25 |
| 3,934,468 | A | | 1/1976 | Brieger | 73/152.25 |
| 3,952,588 | A | | 4/1976 | Whitten | 73/152.25 |
| 4,210,018 | A | | 7/1980 | Brieger | 73/152.26 |
| 4,246,782 | A | | 1/1981 | Hallmark | 73/152.25 |
| 4,248,081 | A | | 2/1981 | Hallmark | 73/152.26 |
| 4,270,385 | A | | 6/1981 | Hallmark | 73/152.26 |
| 4,282,750 | A | | 8/1981 | Prats et al. | 73/152.51 |
| 4,287,946 | A | | 9/1981 | Brieger | 166/100 |
| 4,292,842 | A | | 10/1981 | Hallmark | 73/152.26 |
| 4,339,948 | A | | 7/1982 | Hallmark | 73/152.26 |
| 4,375,164 | A | | 3/1983 | Dodge et al. | 73/152.12 |
| 4,416,152 | A | | 11/1983 | Wilson | 73/152.26 |
| 4,434,653 | A | | 3/1984 | Montgomery | 73/152.24 |
| 4,507,957 | A | | 4/1985 | Montgomery et al. | 73/152.26 |
| 4,513,612 | A | | 4/1985 | Shalek | 73/152.24 |
| 4,593,560 | A | | 6/1986 | Purfurst | 73/152.26 |
| 4,671,322 | A | | 6/1987 | Purfurst | 137/625.27 |
| 4,712,613 | A | | 12/1987 | Nieuwstad | 166/53 |
| 4,720,996 | A | | 1/1988 | Marsden et al. | 73/152.26 |
| 4,742,459 | A | | 5/1988 | Lasseter | 702/12 |
| 4,745,802 | A | | 5/1988 | Purfurst | 73/152.26 |
| 4,782,695 | A | | 11/1988 | Glotin et al. | 73/152.51 |
| 4,799,157 | A | * | 1/1989 | Kucuk et al. | 702/12 |
| 4,833,914 | A | | 5/1989 | Rasmus | 73/152.03 |
| 4,843,878 | A | | 7/1989 | Purfurst et al. | 73/152.24 |
| 4,845,982 | A | | 7/1989 | Gilbert | 73/152.26 |
| 4,860,580 | A | | 8/1989 | DuRocher | 73/152.26 |
| 4,860,581 | A | | 8/1989 | Zimmerman et al. | 73/152.26 |
| 4,862,967 | A | | 9/1989 | Harris | 166/387 |
| 4,879,900 | A | | 11/1989 | Gilbert | 73/152.26 |
| 4,884,439 | A | | 12/1989 | Baird | 73/152.24 |
| 4,890,487 | A | | 1/1990 | Dussan V. et al. | 73/152.05 |
| 4,893,505 | A | | 1/1990 | Marsden et al. | 73/152.24 |
| 4,936,139 | A | | 6/1990 | Zimmerman et al. | 73/152.26 |
| 4,941,350 | A | | 7/1990 | Schneider | 73/152.24 |
| 4,949,575 | A | | 8/1990 | Rasmus | 73/152.03 |
| 4,951,749 | A | | 8/1990 | Carroll | 166/264 |
| 4,962,665 | A | | 10/1990 | Savage et al. | 73/152.28 |
| 4,994,671 | A | | 2/1991 | Safinya et al. | 250/255 |
| 5,056,595 | A | | 10/1991 | Desbrandes | 166/100 |
| 5,095,745 | A | | 3/1992 | Desbrandes | 73/152.24 |
| 5,148,705 | A | | 9/1992 | Desbrandes | 73/152.02 |
| 5,166,747 | A | | 11/1992 | Schroeder et al. | 356/326 |
| 5,167,149 | A | | 12/1992 | Mullins et al. | 73/152.42 |
| 5,184,508 | A | | 2/1993 | Desbrandes | 73/152.05 |
| 5,201,220 | A | | 4/1993 | Mullins et al. | 73/152.42 |
| 5,207,104 | A | | 5/1993 | Enderlin | 73/784 |
| 5,230,244 | A | | 7/1993 | Gilbert | 73/152.17 |
| 5,233,866 | A | | 8/1993 | Desbrandes | 73/152.05 |
| 5,247,830 | A | | 9/1993 | Goode | 73/152.51 |
| 5,265,015 | A | | 11/1993 | Auzerais et al. | 702/12 |
| 5,269,180 | A | | 12/1993 | Dave et al. | 73/152.06 |
| 5,279,153 | A | | 1/1994 | Dussan V. et al. | 73/152.06 |
| 5,303,582 | A | | 4/1994 | Miska | 73/152.21 |
| 5,303,775 | A | | 4/1994 | Michaels et al. | 166/264 |
| 5,329,811 | A | | 7/1994 | Schultz et al. | 73/152.02 |
| 5,335,542 | A | | 8/1994 | Ramakrishnan et al. | 73/152.08 |
| 5,353,637 | A | | 10/1994 | Plumb et al. | 73/152.17 |
| 5,377,755 | A | | 1/1995 | Michaels et al. | 166/264 |
| 5,473,939 | A | | 12/1995 | Leder et al. | 73/152.12 |
| 5,517,854 | A | | 5/1996 | Plumb et al. | 73/152.59 |
| 5,549,159 | A | | 8/1996 | Shwe et al. | 166/250.02 |
| 5,549,162 | A | | 8/1996 | Moody et al. | 166/264 |
| 5,587,525 | A | | 12/1996 | Shwe et al. | 73/152.52 |
| 5,602,334 | A | | 2/1997 | Proett et al. | 73/152.05 |
| 5,622,223 | A | | 4/1997 | Vasquez | 166/264 |
| 5,635,631 | A | | 6/1997 | Yesudas et al. | 73/61.46 |
| 5,644,076 | A | | 7/1997 | Proett et al. | 73/152.41 |
| 5,663,559 | A | | 9/1997 | Auzerais et al. | 250/269.1 |
| 5,672,819 | A | | 9/1997 | Chin et al. | 73/152.41 |
| 5,703,286 | A | | 12/1997 | Proett et al. | 73/152.05 |
| 5,708,204 | A | | 1/1998 | Kasap | 73/152.52 |
| 5,741,962 | A | | 4/1998 | Birchak et al. | 73/152.16 |
| 5,770,798 | A | | 6/1998 | Georgi et al. | 73/152.05 |
| 5,789,669 | A | | 8/1998 | Flaum | 73/152.51 |
| 5,803,186 | A | | 9/1998 | Berger et al. | 175/50 |
| 5,934,374 | A | | 8/1999 | Hrametz et al. | 166/264 |
| 5,969,241 | A | | 10/1999 | Auzerais | 73/152.16 |
| 6,026,915 | A | | 2/2000 | Smith et al. | 175/50 |
| 6,047,239 | A | | 4/2000 | Berger et al. | 702/9 |
| 6,058,773 | A | * | 5/2000 | Zimmerman et al. | 73/152.24 |
| 6,092,416 | A | | 7/2000 | Halford et al. | 73/152.33 |
| 6,111,409 | A | | 8/2000 | Edwards et al. | 324/303 |
| 6,128,949 | A | | 10/2000 | Kleinberg | 73/152.18 |
| 6,157,893 | A | | 12/2000 | Berger et al. | 702/9 |
| 6,164,126 | A | | 12/2000 | Ciglenec et al. | 73/152.01 |
| 6,178,815 | B1 | | 1/2001 | Felling et al. | 73/152.19 |
| 6,223,822 | B1 | | 5/2001 | Jones | 166/250.05 |
| 6,230,557 | B1 | | 5/2001 | Ciglenec et al. | 73/152.01 |
| 6,247,542 | B1 | | 6/2001 | Kruspe et al. | 175/40 |
| 6,274,865 | B1 | | 8/2001 | Schroer et al. | 250/269.1 |
| 6,301,959 | B1 | | 10/2001 | Hrametz et al. | 73/152.23 |
| 6,334,489 | B1 | | 1/2002 | Shwe et al. | 166/250.01 |
| 6,343,507 | B1 | | 2/2002 | Felling et al. | 73/152.19 |
| 6,350,986 | B1 | | 2/2002 | Mullins et al. | 250/269.1 |
| 6,388,251 | B1 | | 5/2002 | Papanyan | 250/269.1 |
| 6,415,648 | B1 | | 7/2002 | Peeters | 73/38 |
| 6,427,530 | B1 | | 8/2002 | Krueger et al. | 73/152.46 |
| 6,439,307 | B1 | | 8/2002 | Reinhardt | 166/264 |
| 6,446,736 | B1 | | 9/2002 | Kruspe et al. | 175/40 |
| 6,474,152 | B1 | | 11/2002 | Mullins et al. | 73/152.22 |
| 6,476,384 | B1 | | 11/2002 | Mullins et al. | 250/269.1 |
| 6,478,096 | B1 | | 11/2002 | Jones et al. | 175/50 |
| 6,513,606 | B1 | | 2/2003 | Krueger | 175/61 |
| 6,516,898 | B1 | | 2/2003 | Krueger | 175/50 |
| 6,568,487 | B2 | | 5/2003 | Meister et al. | 175/50 |
| RE38,129 | E | | 6/2003 | Kleinberg | 73/152.18 |
| 6,581,455 | B1 | | 6/2003 | Berger et al. | 73/152.55 |
| 6,585,045 | B2 | | 7/2003 | Lee et al. | 166/252.5 |
| 6,609,568 | B2 | | 8/2003 | Krueger et al. | 166/250.07 |
| 6,637,524 | B2 | | 10/2003 | Kruspe et al. | 175/40 |
| 6,640,908 | B2 | | 11/2003 | Jones et al. | 175/50 |
| 6,655,458 | B2 | | 12/2003 | Kurkjian et al. | 166/254.2 |
| 6,658,930 | B2 | | 12/2003 | Abbas | 73/152.26 |
| 6,659,177 | B2 | | 12/2003 | Bolze et al. | 166/264 |
| 6,668,924 | B2 | | 12/2003 | Bolze et al. | 166/264 |
| 6,672,386 | B2 | | 1/2004 | Krueger et al. | 166/252.5 |
| 6,688,390 | B2 | | 2/2004 | Bolze et al. | 166/264 |
| 6,719,049 | B2 | | 4/2004 | Sherwood et al. | 166/264 |
| 6,729,399 | B2 | | 5/2004 | Follini et al. | 166/264 |
| 6,745,835 | B2 | | 6/2004 | Fields | 166/264 |
| 6,748,328 | B2 | | 6/2004 | Storm, Jr. et al. | 702/6 |
| 6,758,090 | B2 | | 7/2004 | Bostrom et al. | 73/152.58 |
| 6,763,884 | B2 | | 7/2004 | Meister et al. | 166/264 |
| 6,768,105 | B2 | | 7/2004 | Mullins et al. | 250/269.1 |
| 6,769,296 | B2 | | 8/2004 | Montalvo et al. | 73/152.51 |
| 6,786,086 | B2 | | 9/2004 | Hashem | 73/152.41 |
| 6,799,117 | B1 | | 9/2004 | Proett et al. | 702/12 |
| 6,825,657 | B2 | | 11/2004 | Kleinberg et al. | 324/303 |
| 6,832,515 | B2 | | 12/2004 | Follini et al. | 73/152.02 |
| 2001/0035289 | A1 | | 11/2001 | Runia | 166/66 |
| 2002/0046835 | A1 | | 4/2002 | Lee et al. | 166/250.1 |
| 2002/0060094 | A1 | | 5/2002 | Meister et al. | 175/50 |

| | | | | |
|---|---|---|---|---|
| 2002/0084072 | A1 | 7/2002 | Bolze et al. | 166/264 |
| 2002/0112854 | A1 | 8/2002 | Krueger et al. | 166/250.07 |
| 2002/0129936 | A1 | 9/2002 | Cernosek | 166/264 |
| 2002/0185313 | A1 | 12/2002 | Jones et al. | 175/48 |
| 2002/0189338 | A1 | 12/2002 | Kruspe et al. | 73/152.43 |
| 2002/0189339 | A1 | 12/2002 | Montalvo et al. | 73/152.551 |
| 2003/0042021 | A1 | 3/2003 | Bolze et al. | 166/264 |
| 2003/0062472 | A1 | 4/2003 | Mullins et al. | 250/269.1 |
| 2003/0066646 | A1 | 4/2003 | Shammai et al. | 166/264 |
| 2003/0146022 | A1 | 8/2003 | Krueger | 175/61 |
| 2003/0167834 | A1* | 9/2003 | Weintraub et al. | 73/152.05 |
| 2003/0214879 | A1 | 11/2003 | Proett et al. | 367/81 |
| 2003/0226663 | A1 | 12/2003 | Krueger et al. | 166/252.5 |
| 2004/0007058 | A1 | 1/2004 | Rylander et al. | 73/152.39 |
| 2004/0011525 | A1 | 1/2004 | Jones et al. | 166/264 |
| 2004/0020649 | A1* | 2/2004 | Fields | 166/264 |
| 2004/0026125 | A1* | 2/2004 | Meister et al. | 175/50 |
| 2004/0035199 | A1 | 2/2004 | Meister et al. | 73/152.46 |
| 2004/0045706 | A1 | 3/2004 | Pop et al. | 166/250.07 |
| 2004/0050153 | A1 | 3/2004 | Krueger et al. | 73/152.22 |
| 2004/0050588 | A1 | 3/2004 | Follini et al. | 175/50 |
| 2004/0099443 | A1* | 5/2004 | Meister et al. | 175/58 |
| 2004/0173351 | A1 | 9/2004 | Fox et al. | 166/264 |
| 2004/0230378 | A1 | 11/2004 | Proett et al. | 702/6 |
| 2004/0231408 | A1 | 11/2004 | Shammai | 73/152.27 |
| 2004/0231841 | A1* | 11/2004 | Niemeyer et al. | 166/264 |
| 2004/0231842 | A1* | 11/2004 | Shammai et al. | 166/264 |
| 2004/0260497 | A1* | 12/2004 | DiFoggio et al. | 702/98 |
| 2005/0072565 | A1* | 4/2005 | Segura et al. | 166/100 |

FOREIGN PATENT DOCUMENTS

| | | | |
|---|---|---|---|
| EP | 0994238 | A2 | 4/2000 |
| EP | 0978630 | A2 | 9/2002 |
| GB | 2 304 906 | A | 3/1997 |
| WO | WO 01/33044 | A1 | 5/2001 |
| WO | WO 01/33045 | A1 | 5/2001 |
| WO | WO 01/98630 | A1 | 12/2001 |
| WO | WO 02/08570 | A1 | 1/2002 |

OTHER PUBLICATIONS

A.H. Akram et al.; "A Model to Predict Wireline Formation Tester Sample Contamination"; 1998 SPE Annual Technical Conference and Exhibition; Sep. 27-30, 1998; pp. 27-33; SPE 78959; Society of Petroleum Engineers, Inc.; New Orleans, Louisiana, U.S.A.

R. Desbrandes, et al.; "A New Concept in Wireline Formation Testing: Extended Drawdown," 13th CWLS Formation Evaluation Symp.; 1991; Calgary, Canada; pp. 1-25.

Yi Shaoguo et al.; "A New Flow Model of Pressure Response to Wireline Formation Testing"; Journal of Jianghan Petroleum Institute; vol. 19, No. 3; Sep. 1997; pp. 42-45. (Partial translantion attached).

E. Kasap; "A New, Simplified, Unified Technique For The Analysis of Wireline Formation Test Data"; SPWLA 37th Annual Logging Symposium; Jun. 16-19, 1996; pp. 1-13.

Kun Huang; "A Study of Dimensionless Parameters and Formation Rate Analysis Technique for Interpretation of WFT Data"; 1996; pp. 1-147; University of Tulsa; Tulsa, Oklahoma, U.S.A.

Mark A. Proett et al.; "Advanced Permeability and Anistropy Measurements While Testing and Sampling in Real-Time Using a Dual Probe Formation Tester"; 2000 SPE Annual Technical Conference and Exhibition; Oct. 1-4, 2000; pp. 1-15; SPE 62919; Society of Petroleum Engineers, Inc.; Dallas Texas, U.S.A.

Robert C. Earlougher, Jr.; "Advances in Well Test Analysis"; Society of Petroleum Engineers of AIME; 1997; New York, New York, U.S.A. and Dallas, Texas, U.S.A.

John Michaels et al.; "Advances in Wireline Formation Testing"; SPWLA 36th Annual Logging Symposium; Jun. 26-29, 1995; pp. 1-11.

Amit K. Sakar et al.; "Adverse Effects of Poor Mud Cake Quality: Supercharging and Fluid Sampling Study"; SPE Reservoir Val. & Eng. 3 (3), Jun. 2000; pp. 256-262; Society of Petroleum Engineers, Inc.; U.S.A.

E. B. Dussan V. et al.; "An Analysis of the Pressue Response of a Single-Probe Formation Tester"; 62nd Annual Technical Conference and Exhibition; Sep. 27-30, 1987; pp. 519-527; SPE 16801; Society of Petroleum Engineers, Inc.; Dallas, Texas, U.S.A.

A.A. Grinko et al.; "Analysis of the Quality of Drilling-In of Producing Formation on the Basis of the Results of Tests During Drilling"; Stroit. Neft. Gaz. Skvazhin Sushe More; Apr. May 1999; pp. 45-47; Nos. 4-5; ISSN 0130-3872; Russia.

Ekrem Kasa:; "Analysis of Wireline Formation Test Data From Gas and Non-Darcy Flow Conditions"; 1998 SPE Permian Basin Oil and Gas Recovery Conference; Mar. 25-27, 1998; pp. 183-189; SPE 39769; Society of Petroleum Engineers, Inc.; Midland, Texas, U.S.A.

T. Zimmerman et al.; "Application of Emerging Wireline Formation Testing Technologies"; Eighth Offshore South East Asia Conference; Dec. 4-7, 1990; pp. 83-95; OSEA 90105; Offshore South East Asia; Singapore.

M. Hooper et al.; "Applications for an LWD Formation Tester"; 1999 SPE European Formation Damage Conference; May 25-Jun. 1, 1999; pp. 1-8; SPE 52794; Society of Petroleum Engineers, Inc.; The Hague, The Netherlands.

Cosan Ayan et al.; "Characterizing Permeability with Formation Testers"; Oilfield Review, Autumn 2001; pp. 2-23.

H. Elshahawi et al.; "Correcting for Wettability and Capillary Pressure Effects on Formation Tester Measurements"; SPWLA 41st Annual Logging Symposium; Jun. 4-7, 2000; pp. 1-14; Society of Petroleum Well Log Analysts; Dallas, Texas, U.S.A.

H. Elshahawi et al.; "Correcting for Wettability and Capillary Pressure Effects on Formation Tester Measurements"; 2000 SPE Annual Technical Conference and Exhibition; Oct. 1-4, 2000; pp. 1-15; SPE 63075; Society of Petroleum Engineers, Inc.; Dallas, Texas, U.S.A.

M. D. Enikeev; "Effect of Shaft Curvature on The Results of Formation Testing During the Drilling of Sloping Wells"; May 1978; pp. 26-29; pub. No. 004224; All-Union Sci. Res. Inst of Pet & Geophys. Ind.; USSR. (Partial translantion attached).

Jaedong Lee et al.; "Enhanced Wireline Formation Tests in Low-Permeability Formations: Quality Control Through Formation Rate Analysis"; 2000 SPE Rocky Mountain Regional/Low Permeability Reservoirs Symposium and Exhibition; Mar. 15-15, 2000; pp. 1-4 with Figures 1A-15; SPE 60392; Society of Petroleum Engineers Inc.; Denver, Colorado, U.S.A.

H. Badaam et al.; "Estimation of Formation Properties Using Multiprobe Formation Tester in Layered Reservoirs"; 1998 SPE Annual Technical Conference and Exhibition; Sep. 27-30, 1998; pp. 479-490; SPE 49141; Society of Petroleum Engineers, Inc.; New Orleans, Louisiana, U.S.A.

S.W. Burnie, "Estimation of Reservoir Productivity, Fluid Composition, and Reserves in Sour Gas Formations Using the MDT (Modular Formation Dynamics Tester) Tool and a Comparison with the Completed Well Performance"; 1st CSPG/CWLS Exploration Evaluation & Exploitation Joint Symposium; May 28-31, 1995; 1 p. (Abstract Only); Calgary, Canada.

G. D. Sukhonosov; "Evaluation of Permeability Change Around The Well-Bore Area From Data Obtained With Formation Testers"; Neft Khoz; Oct. 1970; pp. 22-26; No. 10; RUSSIA.

I. Gaz et al.; "Exploring New Methodologies To Acquire DST Type Data"; 1997 Offshore Mediterranean Conference and Exhibiton; Mar. 19-21, 1997; pp. 587-592; Ravenna, Italy.

R. Desbrandes et al.; "Field Applications of Wireline Formation Testers in Low-Permeability Gas Reservoirs"; 1991 SPE Gas Technology Symposium; Jan. 23-25, 1991; pp. 223-236; SPE 21502; Society of Petroleum Engineers, Inc.; Houston, Texas, U.S.A.

Long Haitao; "Follow-Up Monitoring and Evaluation of the Formation Pressure in the Process of Drilling"; Natur. Gas Ind., vol. 20, No. 4, pp. 33-36; Jul. 25, 2000. (Partial translation attached).

M. meister et al.; "Formation Pressure Testing During Drilling: Challenges and Benefits"; SPE Annual Technical Conference and Exhibiton; Oct. 5-8, 2003; pp. 1-8; SPE 84088; Society of Petroleum Engineers, Inc.; Denver, Co, U.S.A.

Mark Proett et al.; "Formation Pressure Testing In The Dynamic Drilling Environment"; 2004 IADC/SPE Drilling Conference; Mar.

2-4, 2004; pp. 1-11; IADC/SPE 87090; Society of Petroleum Engineers, Inc.; Dallas, Texas, U.S.A.
C. Frimann-Dahl et al.; "Formation Testers vs DST—The Cost Effective Use of Transient Analysis to Get Reservoir Parameters"; 1998 SPE Annual Technical Conference; Sep. 27-30, 1998; pp. 1-14, SPE 48962; Society of Petroleum Engineers, Inc.; New Orleans, Louisiana, U.S.A.
P.S. Varlamov et al.; "Formation Testing During Deep Well Drilling"; 1983; pp. 118-124; No. 39; Russia. (Partial translation attached).
Peter A. Goode et al.; "Influence of an Invaded Zone on a Multiprobe Formation Tester"; SPE Formation Evaluation, Mar. 1996; pp. 31-40.
Alastair Crombie et al.; "Innovations in Wireline Fluid Sampling"; pp. 26-41; Oilfield Review, Autumn 1998.
R. Desbrandes; "Invasion Diameter and Supercharging in Time-Lapse MWD/LWD Logging"; Proceedings, Measurement While Drilling Symposium; Feb. 26-27, 1990; pp. 115-135; Louisiana State University; Baton Rouge, Louisiana, U.S.A.
Mark A. Proett et al.; "Low Permeability Interpretation Using a New Wireline Formation Tester 'Tight Zone' Pressure Transient Analysis"; 1994 SPWLA 35th Annual Logging Symposium; Jun. 19-22, 1994; pp. 1-25.
R. Desbrandes et al.; "Measurement While Drilling"; Studies in Abnormal Pressures. Developments in Petroleum Science, 38; 1994; pp. 251-279; Elsevier Science B.V.
Mark A. Proett et al.; "Multiple Factors That Influence Wireline Formation Tester Pressure Measurements and Fluid Contact Estimates"; 2001 SPE Annual Technical Conference and Exhibition; Sep. 30-Oct. 3, 2001; pp. 1-16; SPE 71566; Society of Petroleum Engineers, Inc.; New Orleans, Louisiana, U.S.A.
Mark A. Proett et al.; "New Dual-Probe Wireline Formation Testing and Sampling Tool Enables Real-Time Permeability and Anistropy Measurements"; 2000 SPE Permian Basin Oil and Gas Recovery Conference; Mar. 21-23, 2000; pp. 1-16; SPE 59701; Society of Petroleum Engineers, Inc.; Midland, Texas, U.S.A.
Mark A. Proett et al.; "New Exact Spherical Flow Solution With Storage and Skin For Early-Time Interpretation With Applications to Wireline Formation and Early-Evaluation Drillstem Testing"; 1998 SPE Annual Technical Conference and Exhibition; Sep. 27-30, 1998; pp. 463-478; SPE 49140; Society of Petroleum Engineers, Inc.; New Orleans, Louisiana, U.S.A.
Mark A. Proett et al.; "New Exact Spherical Flow Solution With Storage For Early-Time Interpretation With Applications to Early-Evaluation Drillstem Testing and Wireline Formation Testing"; 1998 SPE Permian Basin Oil and Gas Recovery Conference; Mar. 25-27, 1998; pp. 167-181; SPE 39768; Society of Petroleum Engineers, Inc.; Midland, Texas, U.S.A.
Rob Badry et al.; "New Wireline Formation Tester Techniques and Applications"; 1993 SPWLA Annual Symposium; Jun. 13-16, 1993; pp. 1-15; Calgary, Alberta, Canada.
Mark A. Proett et al.; "New Wireline Formation Testing Tool With Advanced Sampling Technology"; 1999 SPE Annual Technical Conference and Exhibition; Oct. 3-6, 1999; pp. 1-16; SPE 56711; Society of Petroleum Engineers, Inc.; Houston, Texas, U.S.A.
A. F. Shakirov et al.; "On The Regimes of Formation Testing In Wells"; Neft Khoz; Dec. 1973; pp. 14-17; No. 12; RUSSIA.
K. Zainun et al.; "Optimized Exploration Resource Evaluation Using the MDT Tool"; 1995 SPE Asia Pacific Oil and Gas Conference; Mar. 20-22, 1995; pp. 177-194; SPE 29270; Society of Petroleum Engineers, Inc.; Duala Lumpur, Malaysia.
Jaedong Lee et al.; "Pressure Test Analysis of Gas Bearing Formations"; 1998 SPWLA 39th Annual Logging Symposium; May 26-29, 1998; pp. 1-9.
Mark A. Proett et al.; "Real Time Pressure Transient Analysis Methods Applied to Wireline Formation Test Data"; 69th Annual Technical Conference and Exhibition of the Society of Petroleum Engineers; Sep. 25-28, 1994; pp. 1-16; SPE 28449; Society of Petroleum Engineers, Inc.; New Orleans, Louisiana, U.S.A.
V. D. Banchenko et al.; "Results of Using Strata Testers Mounted on Tubes Lowered Into Boreholes in the Southern Mangyshlak Field"; 1982; pp. 28-29; No. 8; ISSN- 0521-8136; Burenie; Russia (Partial translation attached).
E. Kasap et al.; "Robust and Simple Graphical Solution For Wireline Formation Tests: Combined Drawdown and Buildup Analyses"; 1996 SPE Annual Technical Conference and Exhibition; Oct. 6-9, 1996; pp. 343-357; SPE 36525; Society of Petroleum Engineers, Inc.; Denver, Colorado, U.S.A.
S. Haddad et al.; "So What Is The Reservoir Permeability?"; 2000 SPE Annual Technical Conference and Exhibition; Oct. 1-4, 2000; pp. 1-13; SPE 63138; Society of Petroleum Engineers, Inc.; Dallas, Texas, U.S.A.
P. Cooke-Yarborough; "Some 'Quick-Look' and Wellsite Applications of Wireline Formation Testing Tools With Emphasis on Permeability Indicatiors as an Aid to Choosing Net Pay Discriminations"; Proceedings Indonesian Petroleum Association; Thirteenth Annual Convention; may 1994; pp. 1-16.
P. S. Lapshin et al.; "Study of the Effect of Variable Inflow on Accuracy of Determining Formation Parameters with Formation Testers"; 1971; pp. 11-14; No. 1; Nefteprom. Delo; Russia. (Partial translation attached).
Mark A. Proett et al.; "Supercharge Pressure Compensation Using a New Wireline Testing Method and Newly Developed Early Time Spherical Flow Model"; 1996 SPE Annual Technical Conference and Exhibition; Oct. 6-9, 1996; pp. 329-342; SPE 36524; Society of Petroleum Engineers, Inc.: Denver, Colorado, U.S.A.
G.D. Phelps et al.; "The Analysis of the Invaded Zone Characteristics and Their Influence on Wireline Log and Well-Test Interpretation"; 1984 Society of Petroleum Engineers of AIME 59th Annual Conference and Exhibition; Sep. 16-19, 1984; pp. 1-10; Tables 1-4, Figures 1-14; SPE 13287; Society of Petroleum Engineers of AIME; Houston, Texas, U.S.A.
D.K. Sethi et al.; "The Formation Multi-Tester: Its Basic Principles and Practical Field Applications"; SPWLA Twenty-First Annual Logging Symposium; Jul. 8-11, 1980; pp. 1-34.
M.M. Kamal et al.; "Use of Transient Testing in Reservoir Management"; University of Tulsa Centennial Petroleum Engineering Symposium; Aug. 29-31, 1994; pp. 519-531; SPE 28008; Society of Petroleum Engineers; Tulsa, Oklahoma, U.S.A.
"Well Testing Using Wireline Methods"; Schlumberger East Asia Well Evaluation Conference; 1981; pp. 121-144; Singapore.
R. Desbrandes et al.; "Wettability and Productivity Characterization of Low Permeability Gas Formations: Annual Report"; Gas Research Institute; Report GHRI-91/0135; Mar. 6, 1991.
T. M. Whittle et al.; "Will Wireline Formation Tests Replace Well Tests?"; 2003 SPE Annual Technical Conference and Exhibition; Oct. 5-8, 2003; pp. 57-58; SPE 84086; Society of Petroleum Engineers, Inc.; Denver, Colorado, U.S.A.
J. Michaels et al.; "Wireline Fluid Sampling"; 1995 SPE Annual Technical Conference and Exhibition; Oct. 22-25, 2005; pp. 871-878; SPE 36010; Society of Petroleum Engineers, Inc.; Dallas, Texas, U.S.A.
E. C. Thomas; "Wireline Formation Tester Data: Fact or Fiction?"; Petrophysics, vol. 41, No. 5, Sep. -Oct. 2000; pp. 375-378.
R. Desbrandes; "Wireline Formation Testing: A New Extended Drawdown Technique"; Petroleum Engineer International; pp. 40-44; May 1991.

* cited by examiner

METHODS FOR USING A FORMATION TESTER

CROSS-REFERENCE TO RELATED APPLICATIONS

This application claims the benefit of 35 U.S.C. 119(e) from U.S. Provisional Application Ser. No. 60/573,423, filed May 21, 2004 and entitled "Methods and Apparatus for Controlling a Formation Tester Tool Assembly", hereby incorporated herein by reference for all purposes.

STATEMENT REGARDING FEDERALLY SPONSORED RESEARCH OR DEVELOPMENT

Not Applicable.

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation temperature, formation pressure, bubble point, formation pressure gradient, mobility, filtrate viscosity, spherical mobility, coupled compressibility porosity, skin damage (which is an indication of how the mud filtrate has changed the permeability near the wellbore), and anisotropy (which is the ratio of the vertical and horizontal permeabilities). These tests are performed in order to determine whether commercial exploitation of the intersected formations is viable and how to optimize production.

Wireline formation testers (WFT) and drill stem testers (DST) have been commonly used to perform these tests. The basic DST tool consists of a packer or packers, valves, or ports that may be opened and closed from the surface, and two or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart static pressures. A sampling chamber traps formation fluid at the end of the test. WFTs generally employ the same testing techniques but use a wireline to lower the formation tester into the borehole after the drill string has been retrieved from the borehole. The WFT typically uses packers also, although the packers are typically placed closer together, compared to DSTs, for more efficient formation testing. In some cases, packers are not even used. In those instances, the testing tool is brought into contact with the intersected formation and testing is done without zonal isolation.

WFTs may also include a probe assembly for engaging the borehole wall and acquiring formation fluid samples. The probe assembly may include an isolation pad to engage the borehole wall. The isolation pad seals against the formation and around a hollow probe, which places an internal cavity in fluid communication with the formation. This creates a fluid pathway that allows formation fluid to flow between the formation and the formation tester while isolated from the borehole fluid.

In order to acquire a useful sample, the probe must stay isolated from the relative high pressure of the borehole fluid.

Therefore, the integrity of the seal that is formed by the isolation pad is critical to the performance of the tool. If the borehole fluid is allowed to leak into the collected formation fluid, a non-representative sample will be obtained and the test will have to be repeated.

Examples of isolation pads and probes used in WFTs can be found in Halliburton's DT, SFTT, SFT4, and RDT tools. Isolation pads that are used with WFTs are typically rubber pads affixed to the end of the extending sample probe. The rubber is normally affixed to a metallic plate that provides support to the rubber as well as a connection to the probe. These rubber pads are often molded to fit within the specific diameter hole in which they will be operating.

With the use of WFTs and DSTs, the drill string with the drill bit must first be retracted from the borehole. Then, a separate work string containing the testing equipment, or, with WFTs, the wireline tool string, must be lowered into the well to conduct secondary operations. Interrupting the drilling process to perform formation testing can add significant amounts of time to a drilling program.

DSTs and WFTs may also cause tool sticking or formation damage. There may also be difficulties of running WFTs in highly deviated and extended reach wells. WFTs also do not have flowbores for the flow of drilling mud, nor are they designed to withstand drilling loads such as torque and weight on bit.

Further, the formation pressure measurement accuracy of drill stem tests and, especially, of wireline formation tests may be affected by mud filtrate invasion and mudcake buildup because significant amounts of time may have passed before a DST or WFT engages the formation after the borehole has been drilled. Mud filtrate invasion occurs when the drilling mud fluids displace formation fluid. Because the mud filtrate ingress into the formation begins at the borehole surface, it is most prevalent there and generally decreases further into the formation. When filtrate invasion occurs, it may become impossible to obtain a representative sample of formation fluid or, at a minimum, the duration of the sampling period must be increased to first remove the drilling fluid and then obtain a representative sample of formation fluid. Mudcake buildup occurs when any solid particles in the drilling fluid are plastered to the side of the wellbore by the circulating drilling mud during drilling. The prevalence of the mudcake at the borehole surface creates a "skin". Thus there may be a "skin effect" because formation testers can only extend relatively short distances into the formation, thereby distorting the representative sample of formation fluid due to the filtrate. The mudcake also acts as a region of reduced permeability adjacent to the borehole. Thus, once the mudcake forms, the accuracy of reservoir pressure measurements decreases, affecting the calculations for permeability and producibility of the formation.

Another testing apparatus is the formation tester while drilling (FTWD) tool. Typical FTWD formation testing equipment is suitable for integration with a drill string during drilling operations. Various devices or systems are used for isolating a formation from the remainder of the borehole, drawing fluid from the formation, and measuring physical properties of the fluid and the formation. Fluid properties, among other items, may include fluid compressibility, flowline fluid compressibility, density, resistivity, composition, and bubble point. For example, the FTWD may use a probe similar to a WFT that extends to the formation and a small sample chamber to draw in formation fluid through the probe to test the formation pressure. To perform a test, the drill string is stopped from rotating and moving axially and the test procedure, similar to a WFT described above, is performed.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
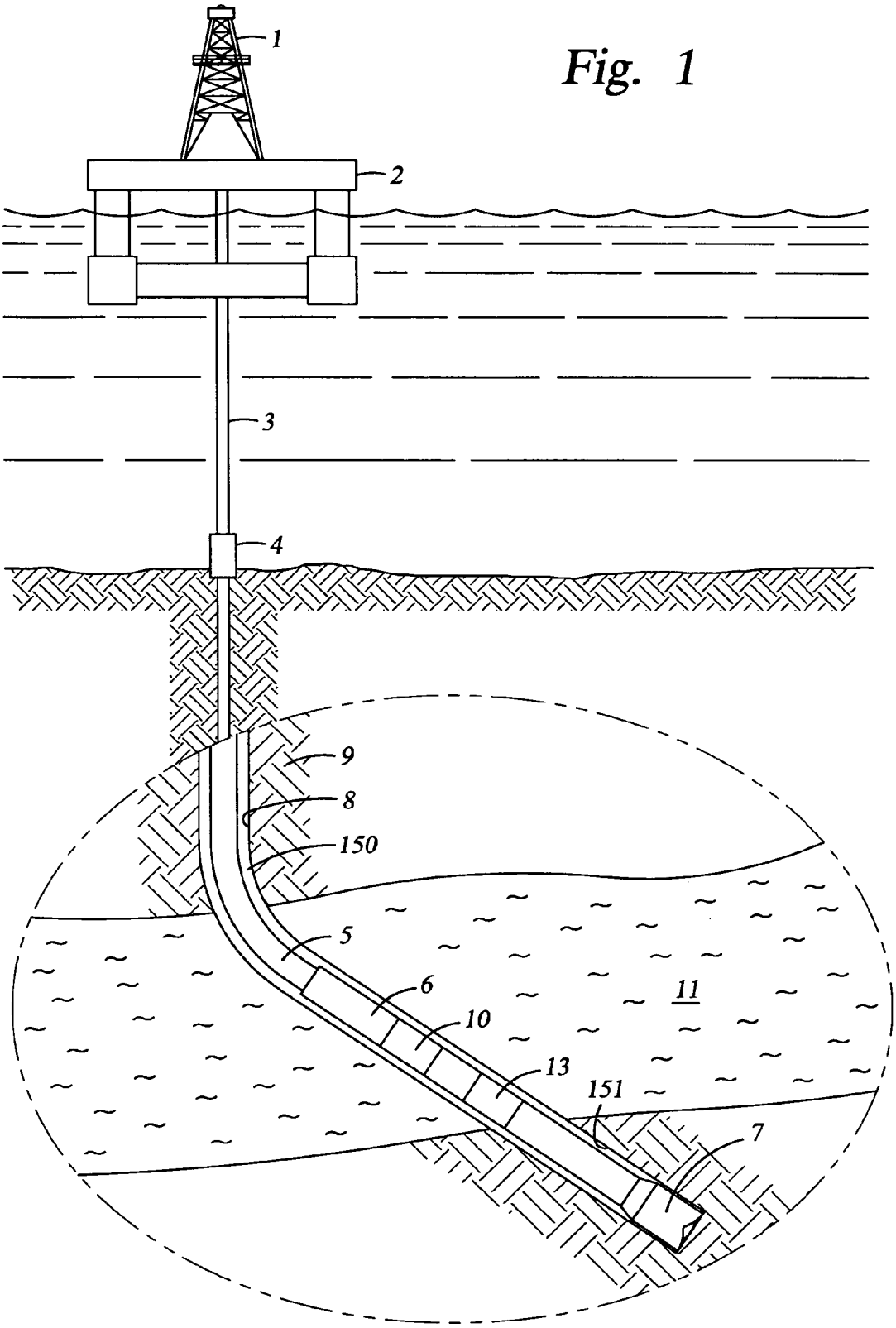
FIG. 1 is a schematic elevation view, partly in cross-section, of an embodiment of the formation tester disposed in a subterranean well.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the terms "couple," "couples", and "coupled" used to describe any electrical connections are each intended to mean and refer to either an indirect or a direct electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the borehole and "down" meaning towards the bottom of the borehole. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring to FIG. 1, an MWD formation tester 10 is illustrated as a part of bottom hole assembly 6 (BHA) that comprises an MWD sub 13 and a drill bit 7 at its lower most end. The BHA 6 is lowered from a drilling platform 2, such as a ship or other conventional platform, via a drill string 5. The drill string 5 is disposed through a riser 3 and a well head 4. Conventional drilling equipment (not shown) is supported within the derrick 1 and rotates the drill string 5 and the drill bit 7, causing the bit 7 to form a borehole 8 through the formation material 9. The borehole 8 penetrates subterranean zones or reservoirs, such as a reservoir 11. It should be understood that the formation tester 10 may be employed in other bottom hole assemblies and with other drilling apparatus in land-based drilling, as well as offshore drilling as shown in FIG. 1. In all instances, in addition to formation tester 10, the bottom hole assembly 6 may contain various conventional apparatus and systems, such as a down hole drill motor, mud pulse telemetry system, measurement-while-drilling sensors and systems, and others well known in the art.

It should also be understood that, even though the MWD formation tester 10 is shown as part of a drill string 5, the embodiments of the invention described below may be conveyed down the borehole 8 via wireline technology, as is partially described above. It should also be understood that the exact physical configuration of the formation tester and the probe assembly is not a requirement of the present invention. The embodiment described below serves to provide an example only. Additional examples of a probe assembly and methods of use are described in U.S. patent application Ser. No. 10/440,593, filed May 19, 2003 and entitled "Method and Apparatus for MWD Formation Testing"; Ser. No. 10/440,835, filed May 19, 2003 and entitled "MWD Formation Tester"; and Ser. No. 10/440/637, filed May 19, 2003 and entitled "Equalizer Valve"; each hereby incorporated herein by reference for all purposes.

The formation tester 10 is best understood with reference to FIGS. 2A–2E. The formation tester 10 generally comprises a heavy walled housing 12 made of multiple sections of drill collar 12*a*,12*b*,12*c*,12*d* that engage one another so as to form the complete housing 12. Bottom hole assembly 6 includes flow bore 14 formed through its entire length to allow passage of drilling fluids from the surface through the drill string 5 and through the bit 7. The drilling fluid passes through nozzles in the drill bit face and flows upwards through borehole 8 along the annulus 150 formed between housing 12 and borehole wall 151.

Figure 2A:
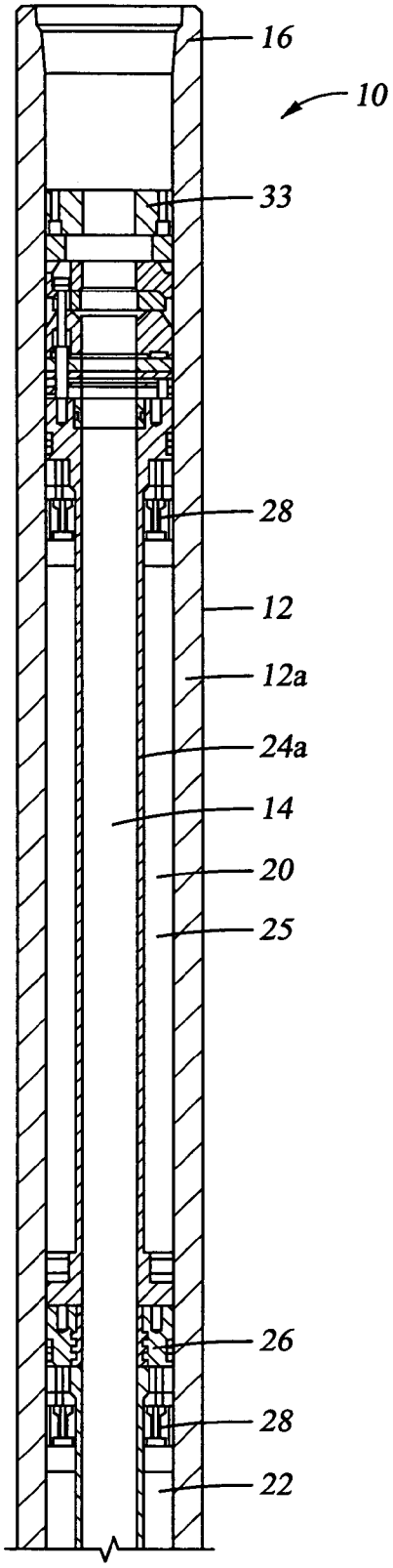
FIGS. 2A–2E are elevation views, partly in cross-section, of portions of the bottomhole assembly and shown in FIG. 1.
Figure 2B:
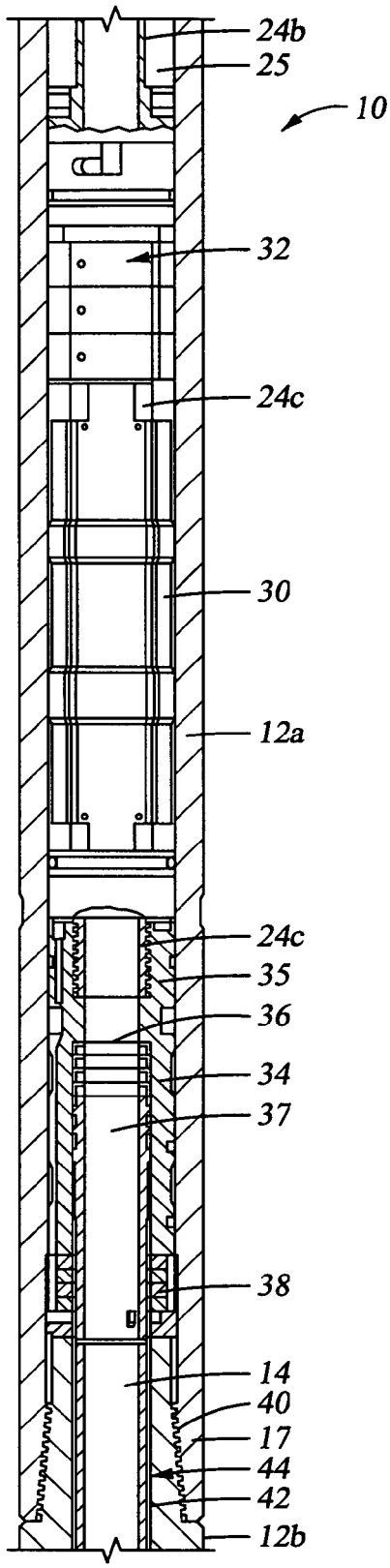

Referring to FIGS. 2A and 2B, upper section 12*a* of housing 12 includes upper end 16 and lower end 17. Upper end 16 may include a threaded box for connecting formation tester 10 to drill string 5. Lower end 17 may include a threaded box for receiving a correspondingly threaded pin end of housing section 12*b*. Disposed between ends 16 and 17 in housing section 12*a* are three aligned and connected sleeves or tubular inserts 24*a,b,c* that create an annulus 25 between sleeves 24*a,b,c* and the inner surface of housing section 12*a*. Annulus 25 is sealed from flowbore 14 and provided for housing a plurality of electrical components, including battery packs 20,22. Battery packs 20,22 are mechanically interconnected at connector 26. Electrical connectors 28 are provided to interconnect battery packs 20,22 to a common power bus (not shown). Beneath battery packs 20,22 and also disposed about sleeve insert 24*c* in annulus 25 is electronics module 30. Electronics module 30 may also include various circuit boards, capacitors banks, and other electrical components, including the capacitors shown at 32. A connector 33 is provided adjacent upper end 16 in housing section 12*a* to electrically couple the electrical components in formation tester 10 with other components of bottom hole assembly 6 that are above housing 12.

Beneath electronics module 30 in housing section 12*a* is an adapter insert 34. Adapter 34 connects to sleeve insert 24*c* at connection 35 and retains a plurality of spacer rings 36 in a central bore 37 that forms a portion of flowbore 14. Lower end 17 of housing section 12*a* connects to housing section 12*b* at threaded connection 40. Spacers 38 are disposed between the lower end of adapter 34 and the pin end of housing section 12*b*. Because threaded connections such as connection 40, at various times, need to be cut and repaired, the length of sections 12*a*, 12*b* may vary in length. Employing spacers 36, 38 allow for adjustments to be made in the length of threaded connection 40.

Housing section 12*b* includes an inner sleeve 44 disposed therethrough. Sleeve 44 extends into housing section 12*a* above, and into housing section 12*c* below. The upper end of sleeve 44 abuts spacers 36 disposed in adapter 34 in housing section 12*a*. An annular area 42 is formed between sleeve 44 and the wall of housing 12*b* and forms a wire way for electrical conductors that extend above and below housing section 12*b*, including conductors controlling the operation of formation tester 10 as described below.

Figure 2C:
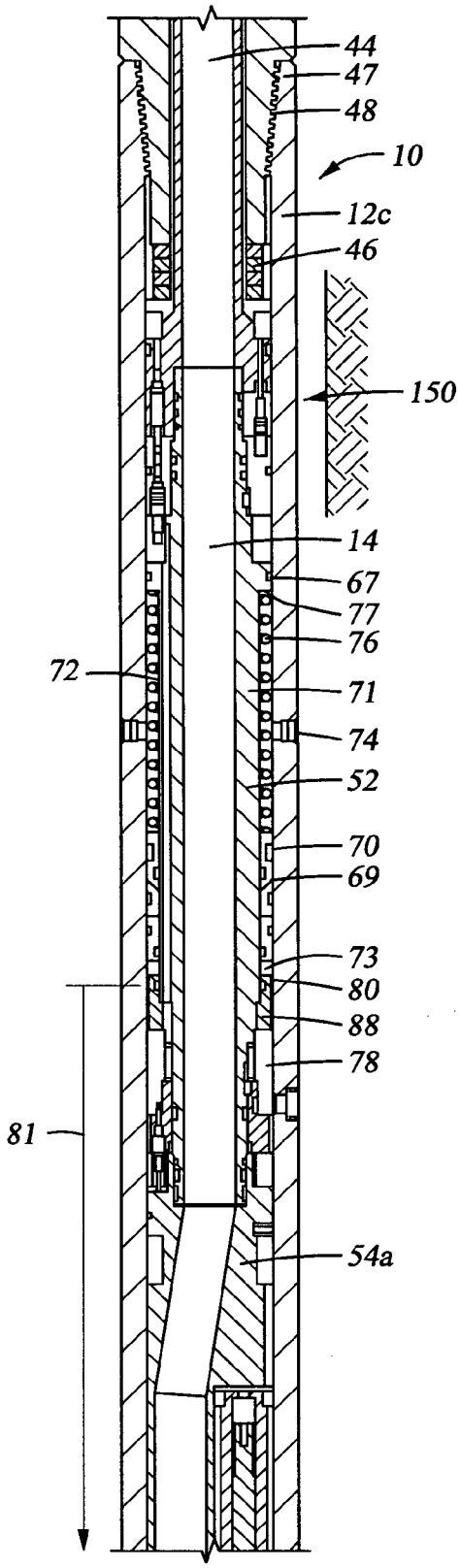
Figure 5:
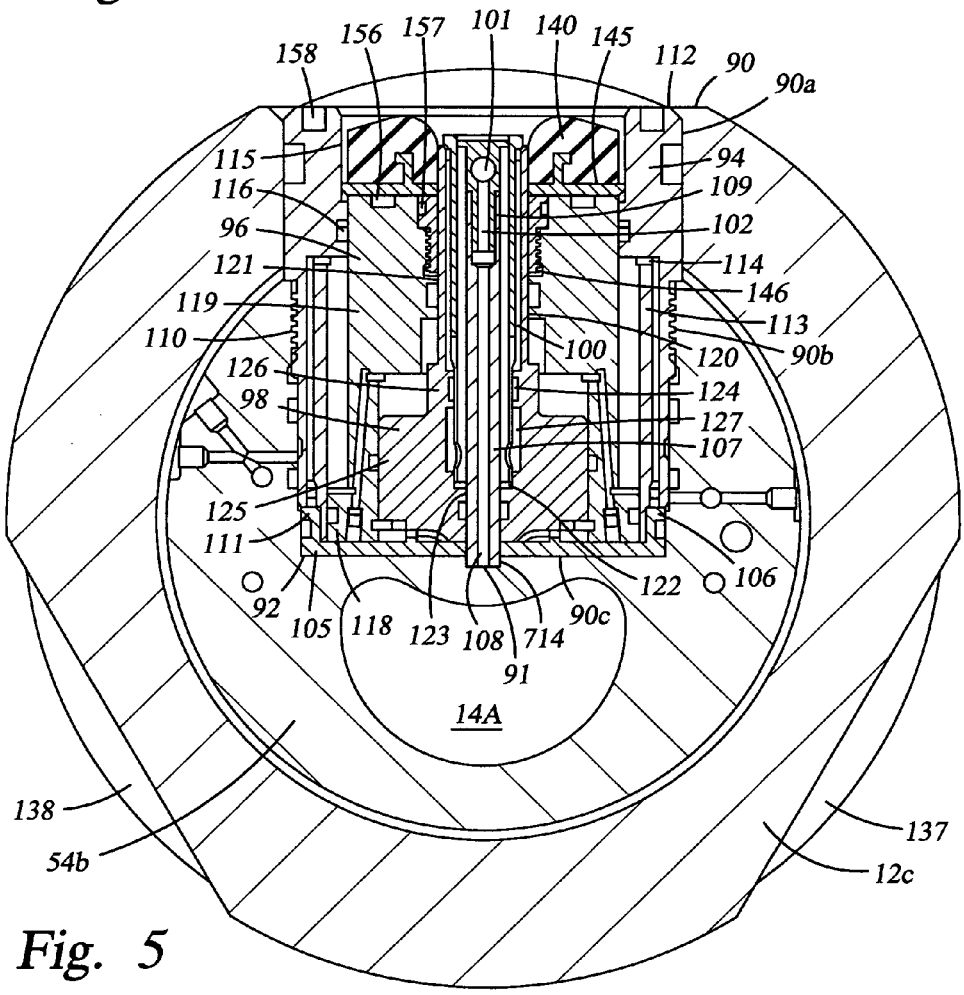
FIG. 5 is a cross-sectional view of the formation probe assembly taken along line 5—5 shown in FIG. 4.

Referring now to FIGS. 2B and 2C, housing section 12*c* includes upper box end 47 and lower box end 48, which may threadingly engage housing section 12*b* and housing section 12*c*, respectively. For the reasons previously explained, adjusting spacers 46 are provided in housing section 12*c* adjacent to end 47. As previously described, insert sleeve 44 extends into housing section 12*c* where it stabs into inner mandrel 52. The lower end of inner mandrel 52 stabs into the upper end of formation tester mandrel 54, which is comprised of three axially aligned and connected sections 54*a, b*, and *c*. Extending through mandrel 54 is a deviated flowbore portion 14*a*. Deviating flowbore 14 into flowbore path 14*a* provides sufficient space within housing section 12*c* for the formation tool components described in more detail below. As best shown in FIG. 2E, deviated flowbore 14*a* eventually centralizes near the lower end 48 of housing section 12*c*, shown generally at location 56. Referring momentarily to FIG. 5, the cross-sectional profile of deviated flowbore 14*a* may be a non-circular in segment 14*b*, so as to provide as much room as possible for the formation probe assembly 50.

Figure 2D:
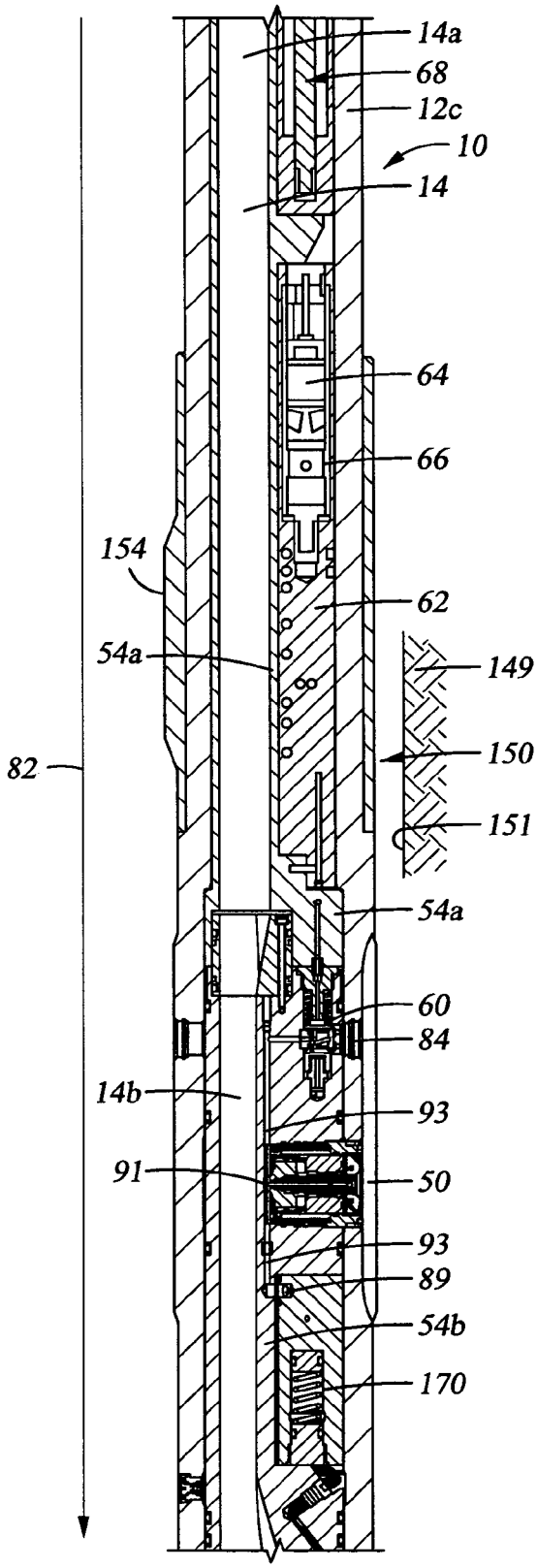
Figure 2E:
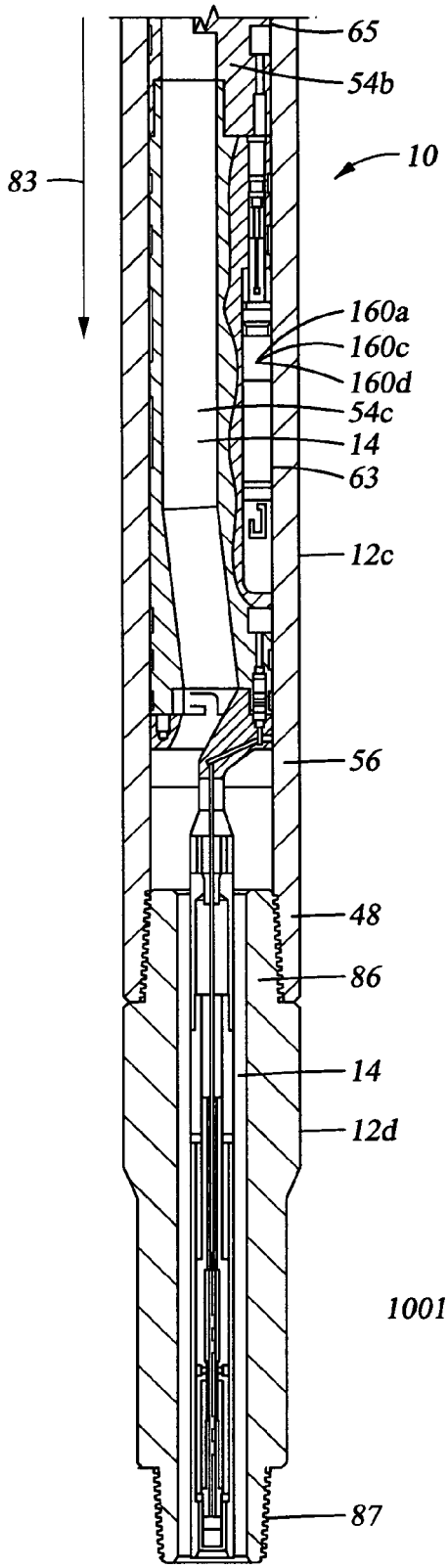

As best shown in FIGS. 2D and 2E, disposed about formation tester mandrel 54 and within housing section 12*c* are electric motor 64, hydraulic pump 66, hydraulic manifold 62, equalizer valve 60, formation probe assembly 50, pressure transducers 160, and drawdown piston 170. Hydraulic accumulators provided as part of the hydraulic system 200 for the operating formation probe assembly 50 are also disposed about mandrel 54 in various locations, one such accumulator 68 being shown in FIG. 2D.

Electric motor 64 may be a permanent magnet motor powered by battery packs 20,22 and capacitor banks 32. Motor 64 is interconnected to and drives hydraulic pump 66. Pump 66 provides fluid pressure for actuating formation probe assembly 50. Hydraulic manifold 62 includes various solenoid valves, check valves, filters, pressure relief valves, thermal relief valves, pressure transducer 160*b* and hydraulic circuitry employed in actuating and controlling formation probe assembly 50 as explained in more detail below.

Referring again to FIG. 2C, mandrel 52 includes a central segment 71. Disposed about segment 71 of mandrel 52 are pressure balance piston 70 and spring 76. Mandrel 52 includes a spring stop extension 77 at the upper end of segment 71. Stop ring 88 is threaded to mandrel 52 and includes a piston stop shoulder 80 for engaging corresponding annular shoulder 73 formed on pressure balance piston 70. Pressure balance piston 70 further includes a sliding annular seal or barrier 69. Barrier 69 consists of a plurality of inner and outer o-ring and lip seals axially disposed along the length of piston 70.

Beneath piston 70 and extending below inner mandrel 52 is a lower oil chamber or reservoir 78, described more fully below. An upper chamber 72 is formed in the annulus between central portion 71 of mandrel 52 and the wall of housing section 12*c*, and between spring stop portion 77 and pressure balance piston 70. Spring 76 is retained within chamber 72, which is open through port 74 to annulus 150. As such, drilling fluids may fill chamber 72 in operation. An annular seal 67 is disposed about spring stop portion 77 to prevent drilling fluid from migrating above chamber 72.

Barrier 69 maintains a seal between the drilling fluid in chamber 72 and the hydraulic oil that fills and is contained in oil reservoir 78 beneath piston 70. Lower chamber 78 extends from barrier 69 to seal 65 located at a point generally noted as 83 and just above transducers 160 in FIG. 2E. The oil in reservoir 78 completely fills all space between housing section 12*c* and formation tester mandrel 54. The hydraulic oil in chamber 78 may be maintained at slightly greater pressure than the pressure of the drilling fluid in annulus 150. The annulus pressure is applied to piston 70 via drilling fluid entering chamber 72 through port 74. Because lower oil chamber 78 is a closed system, the annulus pressure that is applied via piston 70 is applied to the entire chamber 78. Additionally, spring 76 provides a slightly greater pressure to the closed oil system 78 such that the pressure in oil chamber 78 is substantially equal to the annulus fluid pressure plus the pressure added by the spring force. This slightly greater oil pressure is desirable so as to maintain positive pressure on all the seals in oil chamber 78. Between barrier 69 in piston 70 and point 83, the hydraulic oil fills all the space between the outside diameter of mandrels 52, 54 and the inside diameter of housing section 12*c*, this region being marked as distance 82 between points 81 and 83. The oil in reservoir 78 is employed in the hydraulic circuit 200 (FIG. 10) used to operate and control formation probe assembly 50 as described in more detailed below.

Figure 3:
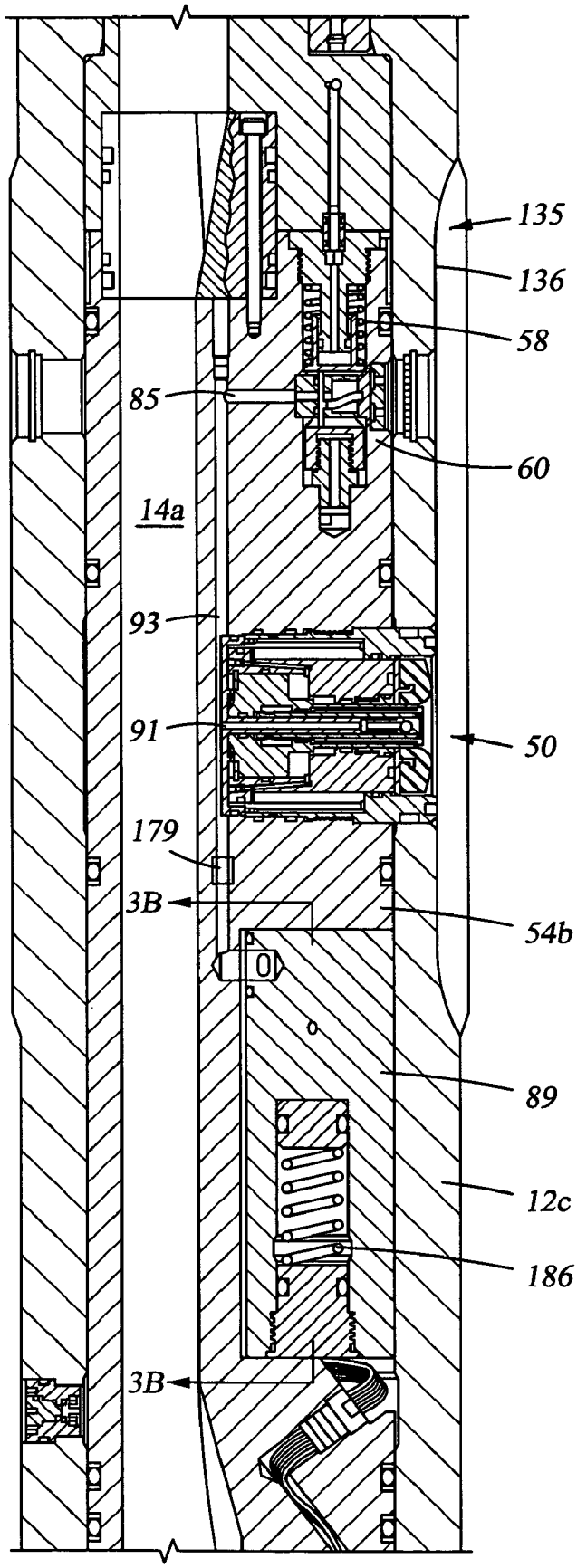
FIG. 3 is an enlarged elevation view, partly in cross-section, of the formation tester shown in FIG. 2D.

Equalizer valve 60, best shown in FIG. 3, is disposed in formation tester mandrel 54*b* between hydraulic manifold 62 and formation probe assembly 50. Equalizer valve 60 is in fluid communication with hydraulic passageway 85 and with longitudinal fluid passageway 93 formed in mandrel 54*b*. Prior to actuating formation probe assembly 50 so as to test the formation, drilling fluid fills passageways 85 and 93 as valve 60 is normally open and communicates with annulus 150 through port 84 in the wall of housing section 12*c*. When the formation fluid is being sampled by formation probe assembly 50, valve 60 closes the passageway 85 to prevent drilling fluids from annulus 150 entering passageway 85 or passageway 93. A valve particularly well suited for use in this application is the valve described in U.S. patent application Ser. No. 10/440/637, filed May 19, 2003 and entitled "Equalizer Valve", hereby incorporated herein by reference for all purposes.

Figure 4:
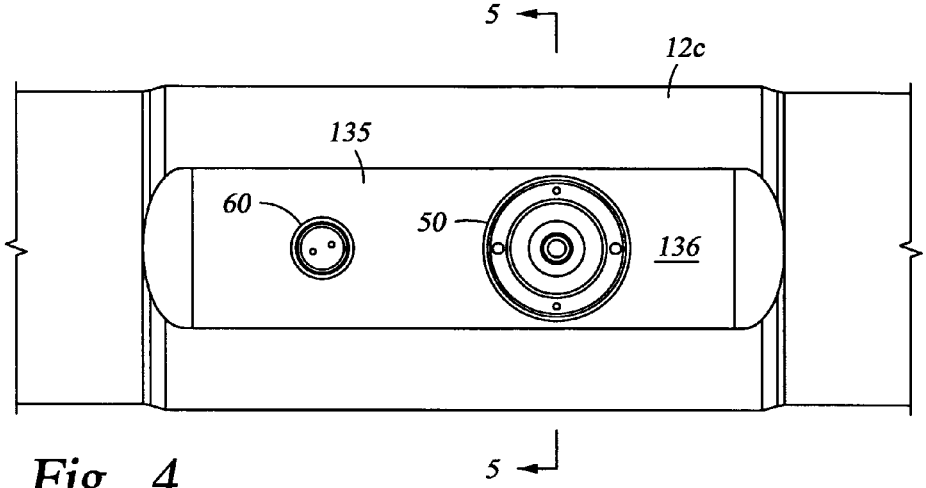
FIG. 4 is an elevation view of the formation tester shown in FIG. 3.

As shown in FIGS. 3 and 4, housing section 12*c* includes a recessed portion 135 adjacent to formation probe assembly 50 and equalizer valve 60. The recessed portion 135 includes a planar surface or "flat" 136. The ports through which fluids may pass into equalizing valve 60 and probe assembly 50 extend through flat 136. In this manner, as drill string 5 and formation tester 10 are rotated in the borehole, formation probe assembly 50 and equalizer valve 60 are better protected from impact, abrasion, and other forces. Flat 136 may be recessed at least ¼ inch and may be at least ½ inch from the outer diameter of housing section 12*c*. Similar flats 137,138 are also formed about housing section 12*c* at generally the same axial position as flat 136 to increase flow area for drilling fluid in the annulus 150 of borehole 8.

Disposed about housing section 12*c* adjacent to formation probe assembly 50 is stabilizer 154. Stabilizer 154 may have an outer diameter close to that of nominal borehole size. As explained below, formation probe assembly 50 includes a seal pad 140 that is extendable to a position outside of housing 12*c* to engage the borehole wall 151. As explained, probe assembly 50 and seal pad 140 of formation probe assembly 50 are recessed from the outer diameter of housing section 12*c*, but they are otherwise exposed to the environment of annulus 150 where they could be impacted by the borehole wall 151 during drilling or during insertion or retrieval of bottom hole assembly 6. Accordingly, being positioned adjacent to formation probe assembly 50, stabilizer 154 provides additional protection to the seal pad 140 during insertion, retrieval, and operation of bottom hole assembly 6. It also provides protection to pad 140 during operation of formation tester 10. In operation, a piston extends seal pad 140 to a position where it engages the borehole wall 151. The force of the pad 140 against the borehole wall 151 would tend to move the formation tester 10 in the borehole, and such movement could cause pad 140 to become damaged. However, as formation tester 10 moves sideways within the borehole as the piston is extended into engagement with the borehole wall 151, stabilizer 154 engages the borehole wall and provides a reactive force to counter the force applied to the piston by the formation. In this manner, further movement of the formation tester 10 is resisted.

Referring to FIG. 2E, mandrel 54*c* contains chamber 63 for housing pressure transducers 160*a,c,d* as well as electronics for driving and reading these pressure transducers. In addition, the electronics in chamber 63 contain memory, a microprocessor, and power conversion circuitry for properly utilizing power from power bus 700.

Referring still to FIG. 2E, housing section 12*d* includes pins ends 86,87. Lower end 48 of housing section 12*c* threadingly engages upper end 86 of housing section 12*d*. Beneath housing section 12*d*, and between formation tester 10 and drill bit 7 are other sections of the bottom hole assembly 6 that constitute conventional MWD tools, generally shown in FIG. 1 as MWD sub 13. In a general sense, housing section 12*d* is an adapter used to transition from the lower end of formation tester 10 to the remainder of the bottom hole assembly 6. The lower end 87 of housing section 12*d* threadingly engages other sub assemblies included in bottom hole assembly 6 beneath formation tester 10. As shown, flowbore 14 extends through housing section 12*d* to such lower subassemblies and ultimately to drill bit 7.

Figure 3A:
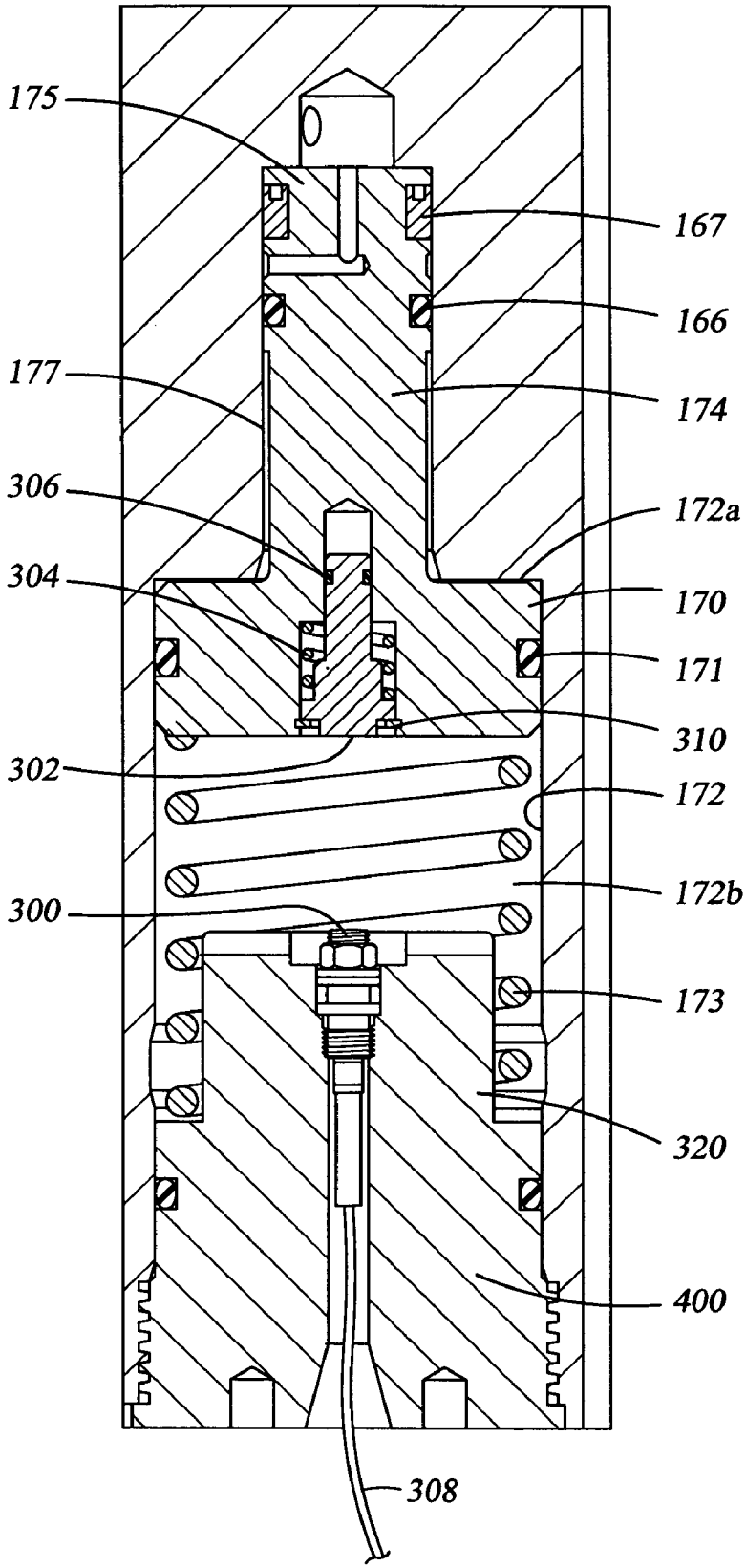
FIG. 3A is an enlarged cross-section view of the draw-down piston and chamber shown in FIG. 3.
Figure 3B:
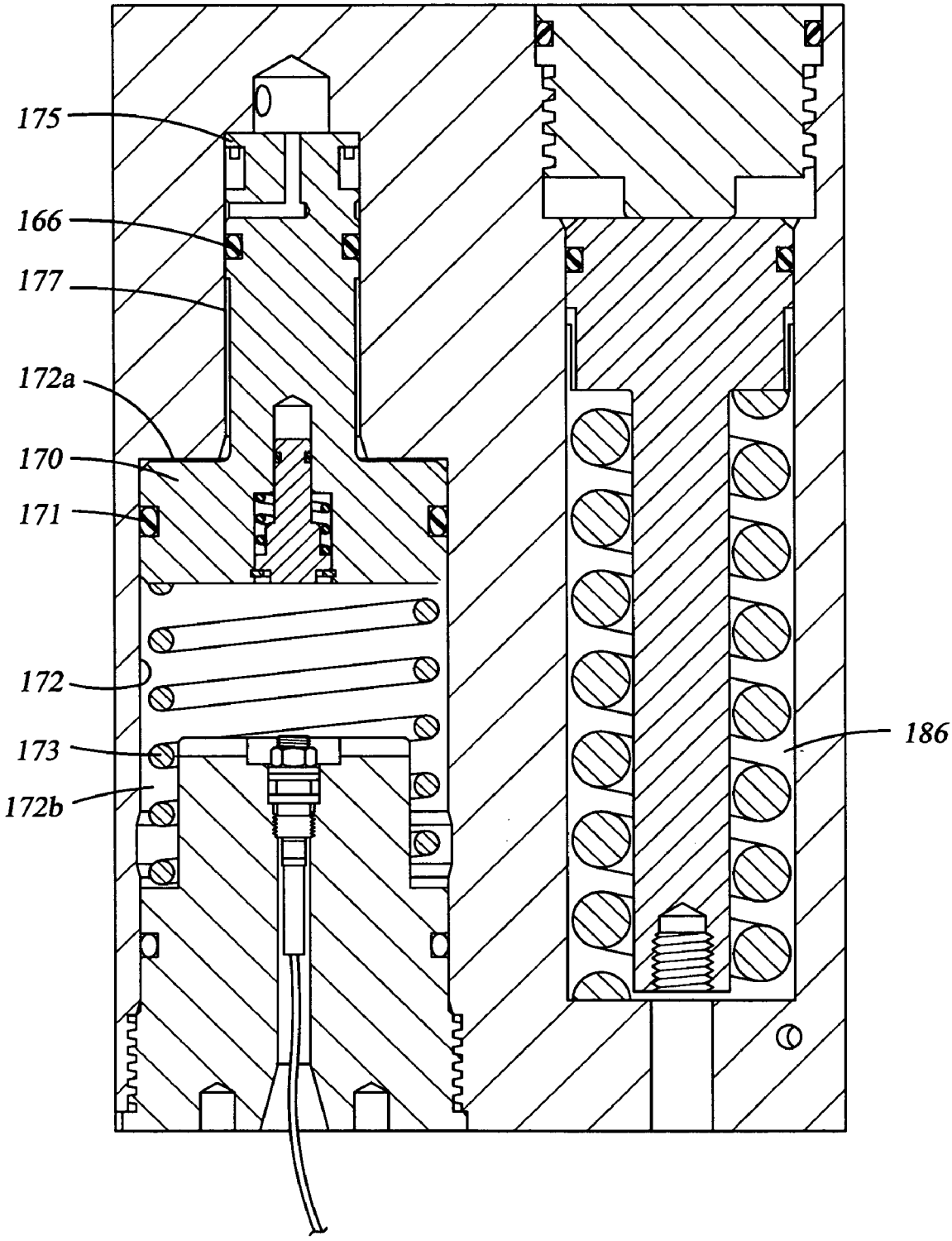
FIG. 3B is an enlarged cross-section view along line 3B—3B of FIG. 3.

Referring again to FIG. 3 and to FIG. 3A, drawdown piston 170 is retained in drawdown manifold 89 that is mounted on formation tester mandrel 54*b* within housing 12*c*. Drawdown piston 170 includes annular seal 171 and is slidingly received in cylinder 172. Spring 173 biases drawdown piston 170 to its uppermost or shouldered position as shown in FIG. 3A. Separate hydraulic lines (not shown) interconnect with cylinder 172 above and below drawdown piston 170 in portions 172*a*, 172*b* to move drawdown piston 170 either up or down within cylinder 172 as described more fully below. A plunger 174 is integral with and extends from drawdown piston 170. Plunger 174 is slidingly disposed in cylinder 177 coaxial with 172. Cylinder 175 is the upper portion of cylinder 177 that is in fluid communication with the longitudinal passageway 93 as shown in FIG. 3A. A flowline valve 179 controls flow of fluid through the passageway 93 between the drawdown piston 170 and the probe assembly 50. Cylinder 175 is flooded with drilling fluid via its interconnection with passageway 93. Cylinder 177 is filled with hydraulic fluid beneath seal 166 via its interconnection with hydraulic circuit 200. Plunger 174 also contains scraper 167 that protects seal 166 from debris in the drilling fluid. Scraper 167 may be an o-ring energized lip seal.

As best shown in FIG. 5, formation probe assembly 50 generally includes stem 92, a generally cylindrical adapter sleeve 94, piston 96 adapted to reciprocate within adapter sleeve 94, and a snorkel assembly 98 adapted for reciprocal movement within piston 96. Housing section 12*c* and formation tester mandrel 54*b* include aligned apertures 90*a*, 90*b*, respectively, that together form aperture 90 for receiving formation probe assembly 50.

Stem 92 includes a circular base portion 105 with an outer flange 106. Extending from base 105 is a tubular extension 107 having central passageway 108. The end of extension 107 includes internal threads at 109. Central passageway 108 is in fluid connection with fluid passageway 91 that, in turn, is in fluid communication with longitudinal fluid chamber or passageway 93, best shown in FIG. 3.

Adapter sleeve 94 includes inner end 111 that engages flange 106 of stem number 92. Adapter sleeve 94 is secured within aperture 90 by threaded engagement with mandrel 54*b* at segment 110. The outer end 112 of adapter sleeve 94 extends to be substantially flushed with flat 136 formed in housing member 12*c*. Circumferentially spaced about the outermost surface of adapter sleeve 94 is a plurality of tool engaging recesses 158. These recesses are employed to thread adapter 94 into and out of engagement with mandrel 54*b*. Adapter sleeve 94 includes cylindrical inner surface 113 having reduced diameter portions 114,115. A seal 116 is disposed in surface 114. Piston 96 is slidingly retained within adapter sleeve 94 and generally includes base section 118 and an extending portion 119 that includes inner cylindrical surface 120. Piston 96 further includes central bore 121.

The snorkel 98 includes a base portion 125, a snorkel extension 126, and a central passageway 127 extending through base 125 and extension 126.

The probe assembly 50 is assembled such that piston base 118 is permitted to reciprocate along surface 113 of adapter sleeve 94. Similarly, the snorkel base 125 is disposed within piston 96 and the snorkel extension 126 is adapted for reciprocal movement along the piston surface 120. Central passageway 127 of the snorkel 98 is axially aligned with tubular extension 107 of the stem 92 and with the screen 100.

Figure 6C:
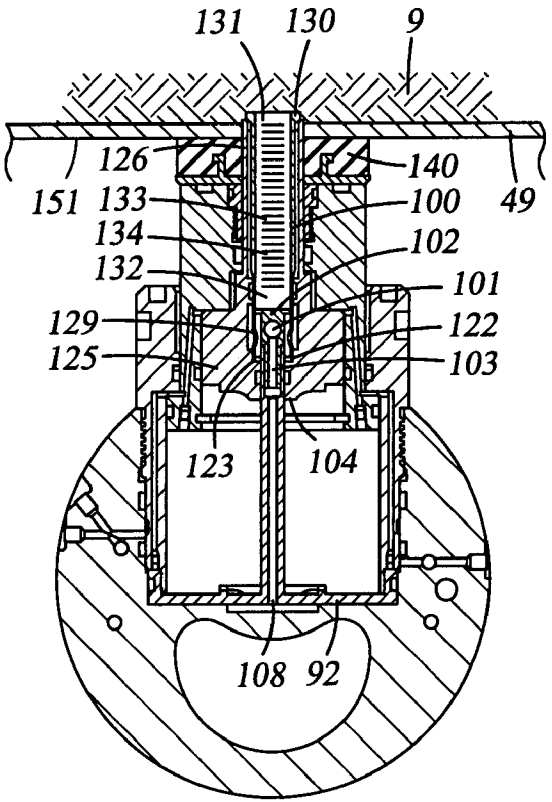
FIGS. 6A–6C are cross-sectional views of a portion of the formation probe assembly taken along the same line as seen in FIG. 5, the probe assembly being shown in a different position in each of FIGS. 6A–6C.

Referring to FIGS. 5 and 6C, screen 100 is a generally tubular member having a central bore 132 extending between a fluid inlet end 131 and outlet end 122. Outlet end 122 includes a central aperture 123 that is disposed about stem extension 107. Screen 100 further includes a flange 130 adjacent to fluid inlet end 131 and an internally slotted segment 133 having slots 134. Apertures 129 are formed in screen 100 adjacent end 122. Between slotted segment 133 and apertures 129, screen 100 includes threaded segment 124 for threadingly engaging snorkel extension 126.

The scraper 102 includes a central bore 103, threaded extension 104, and apertures 101 that are in fluid communication with central bore 103. Section 104 threadingly engages internally threaded section 109 of stem extension 107, and is disposed within central bore 132 of screen 100.

Referring now to FIGS. 5 and 7–9, seal pad 140 may be generally donut-shaped having base surface 141, an opposite sealing surface 142 for sealing against the borehole wall, a circumferential edge surface 143 and a central aperture 144. In the embodiment shown, base surface 141 is generally flat and is bonded to a metal skirt 145. Seal pad 140 seals and prevents drilling fluid from entering the probe assembly 50 during formation testing so as to enable pressure transducers 160 to measure the pressure of the formation fluid. Changes in formation fluid pressure over time provide an indication of the permeability of the formation 9. More specifically, seal pad 140 seals against the mudcake 49 that forms on the borehole wall. Typically, the pressure of the formation fluid is less than the pressure of the drilling fluids that are injected into the borehole. A layer of residue from the drilling fluid forms a mudcake 49 on the borehole wall and separates the two pressure areas. Pad 140, when extended, conforms its shape to the borehole wall and, together with the mudcake 49, forms a seal through which formation fluid can be collected.

As best shown in FIGS. 3, 5, and 6, pad 140 is sized so that it can be retracted completely within aperture 90. In this position, pad 140 is protected both by flat 136 that surrounds aperture 90 and by recess 135 that positions face 136 in a setback position with respect to the outside surface of housing 12.

Pad 140 may be made of an elastomeric material having a high elongation characteristic. At the same time, the material may possess relatively hard and wear resistant characteristics. More particularly, the material may have an elongation % equal to at least 200% and even more than 300%. One such material useful in this application is Hydrogenated Nitrile Butadiene Rubber (HNBR). A material found particularly useful for pad 140 is HNBR compound number 372 supplied by Eutsler Technical Products of Houston, Tex., U.S.A. having a durometer hardness of 85 Shore A and a percent elongation of 370% at room temperature.

Figure 7:
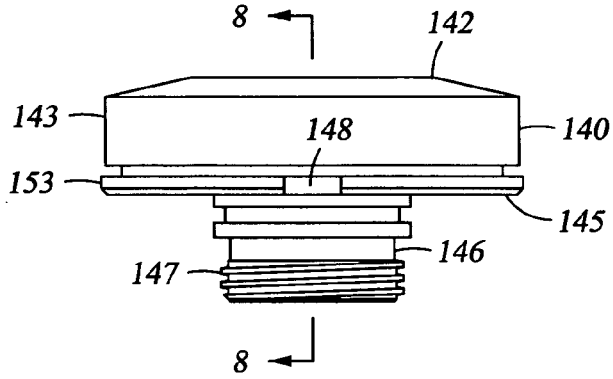
FIG. 7 is an elevation view of the probe pad mounted on the skirt in one embodiment employed in the formation probe assembly shown in FIGS. 4 and 5.
Figure 8:
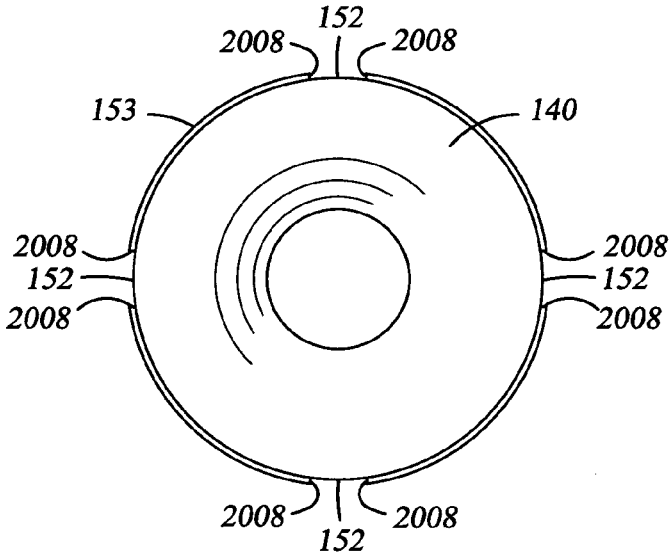
FIG. 8 is a top view of the probe pad shown in FIG. 7.
Figure 9:
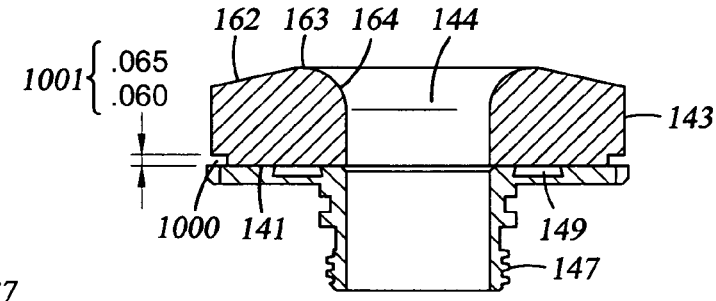
FIG. 9 is a cross-sectional view of the probe pad and skirt taken along line A—A in FIG. 7.

One possible profile for pad 140 is shown in FIGS. 7–9. Sealing surface 142 of pad 140 generally includes a spherical surface 162 and radius surface 164. Spherical surface 162 begins at edge 143 and extends to point 163 where spherical surface 162 merges into and thus becomes a part of radius surface 164. Radius surface 164 curves into central aperture 144 which passes through the center of the pad 140. In the embodiment shown in FIGS. 7–9, pad 140 includes an overall diameter of 2.25 inches with the diameter of central aperture 144 being equal to 0.75 inches. Radius surface 164 has a radius of 0.25 inches, and spherical surface 162 has a spherical radius equal to 4.25 inches. The height of the profile of pad 140 is 0.53 inches at its thickest point.

Referring again to FIGS. 7-9, when pad 140 is compressed, it may extrude into the recesses 152 in skirt 145. The corners 2008 of the recesses 152 can damage the pad, resulting in premature failure. An undercut feature 1000 shown in FIGS. 7 and 9 is cut into the pad to give space between the elastomeric pad 140 and the recesses 152.

As best shown in FIG. 7, skirt 145 includes an extension 146 for threadingly engaging extending portion 119 of piston 96 (FIG. 5) at threaded segment 147 (FIGS. 7 and 9). Skirt 145 may also include dovetail groove 149*a* as shown in FIG. 9. When molded, the elastomer fills the dovetail groove. The groove acts to retain the elastomer in the event of de-bonding between the metal skirt 145 and the pad 140. As shown in FIG. 5, snorkel extension 126 supports the central aperture 144 of pad 140 (FIG. 7) to reduce the extrusion of the elastomer when it is pressed against the borehole wall during a formation test. Reducing extrusion of the elastomer helps to ensure a good pad seal, especially against the high differential pressure seen across the pad during a formation test.

To help with a good pad seal, tool 10 may include, among other things, centralizers for centralizing the formation probe assembly 50 and thereby normalizing pad 140 relative to the borehole wall. For example, the formation tester 10 may include centralizing pistons coupled to a hydraulic fluid circuit configured to extend the pistons in such a way as to protect the probe assembly and pad, and also to provide a good pad seal. A formation tester including such devices is described in U.S. patent application Ser. No. 10/440,593, filed May 19, 2003 and entitled "Method and Apparatus for MWD Formation Testing", hereby incorporated herein by reference for all purposes.

Figure 10:
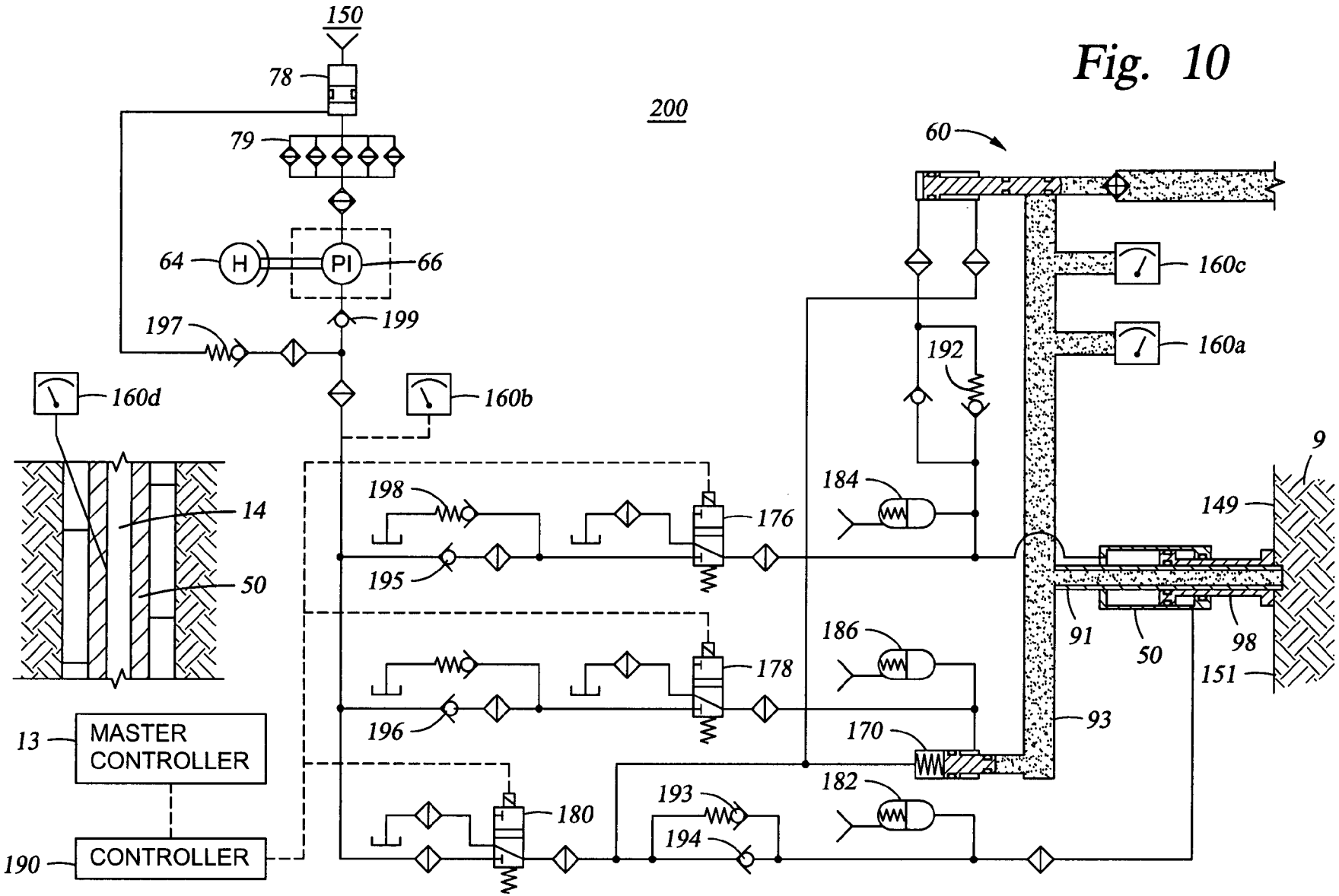
FIG. 10 is a schematic view of a hydraulic circuit employed in actuating the formation tester.

The hydraulic circuit 200 used to operate probe assembly 50, equalizer valve 60, and drawdown piston 170 is illustrated in FIG. 10. A microprocessor-based controller 190 is electrically coupled to all of the controlled elements in the hydraulic circuit 200 illustrated in FIG. 10, although the electrical connections to such elements are conventional and are not illustrated other than schematically. Controller 190 is located in electronics module 30 in housing section 12*a*, although it could be housed elsewhere in bottom hole assembly 6. Controller 190 detects the control signals transmitted from a master controller (not shown) housed in the MWD sub 13 of the bottom hole assembly 6 which, in turn, receives instructions transmitted from the surface via mud pulse telemetry, or any of various other conventional means for transmitting signals to downhole tools.

Controller 190 receives a command to initiate formation testing. This command may be received when the drill string is rotating or sliding or otherwise moving; however the drill string must be stationary during a formation test. As shown in FIG. 10, motor 64 is coupled to pump 66 that draws hydraulic fluid out of hydraulic reservoir 78 through a serviceable filter 79. As will be understood, the pump 66 directs hydraulic fluid into hydraulic circuit 200 that includes formation probe assembly 50, equalizer valve 60, drawdown piston 170 and solenoid valves 176,178,180.

The operation of the formation tester 10 is best understood in reference to FIG. 10 in conjunction with FIGS. 3A, 5, and 6A–C. In response to an electrical control signal, the controller 190 energizes solenoid valve 180 and starts motor 64. Pump 66 then begins to pressurize hydraulic circuit 200 and, more particularly, charges probe retract accumulator 182. The act of charging accumulator 182 also ensures that the probe assembly 50 is retracted and that drawdown piston 170 is in its initial shouldered position as shown in FIG. 3A. When the pressure in system 200 reaches a predetermined value, such as 1800 psi as sensed by pressure transducer 160*b*, the controller 190, which continuously monitors pressure in the hydraulic circuit 200, energizes solenoid valve 176 and de-energizes solenoid valve 180, which causes the probe piston 96 and the snorkel 98 to begin to extend toward the borehole wall 151. Concurrently, check valve 194 and relief valve 193 seal the probe retract accumulator 182 at a pressure charge of between approximately 500 to 1250 psi.

Figure 6B:
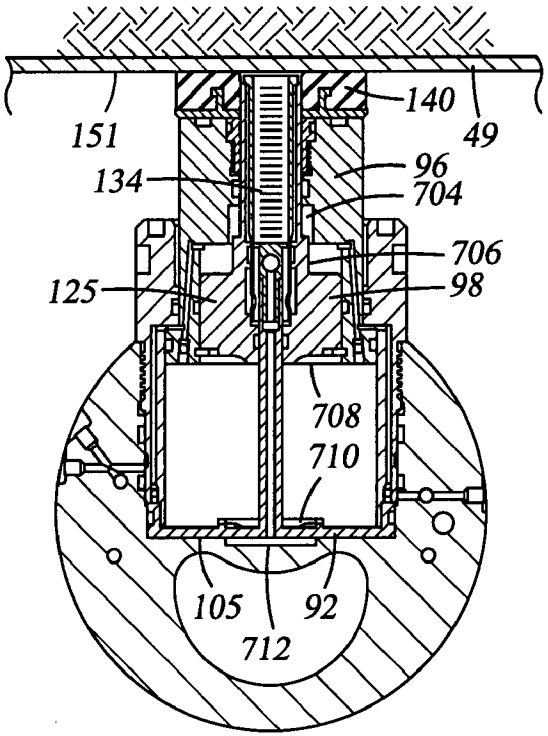
Figure 6A:
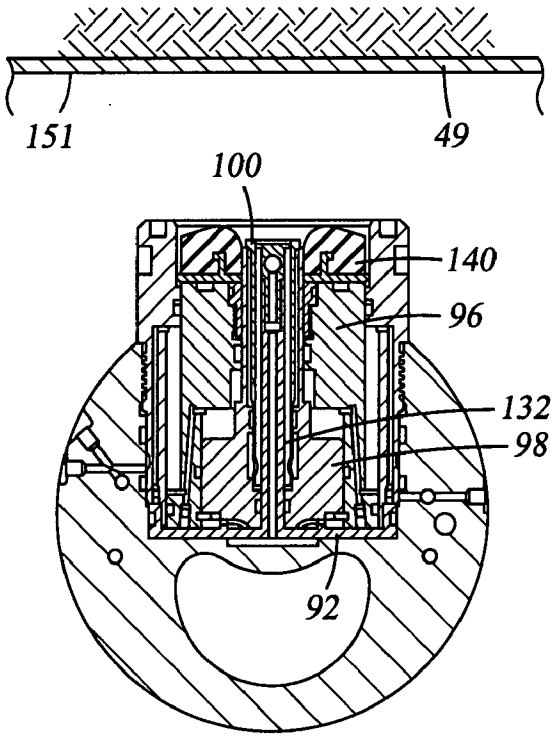

The piston 96 and the snorkel 98 extend from the position shown in FIG. 6A to that shown in FIG. 6B where the pad 140 engages the mudcake 49 on the borehole wall 151. With hydraulic pressure continued to be supplied to the extend side of the piston 96 and snorkel 98, the snorkel then penetrates the mudcake as shown in FIG. 6C. There are two expanded positions of snorkel 98, generally shown in FIGS. 6B and 6C. The piston 96 and snorkel 98 move outwardly together until the pad 140 engages the borehole wall 151. This combined motion continues until the force of the borehole wall against pad 140 reaches a pre-determined magnitude, for example 5,500 lb, causing pad 140 to be squeezed. At this point, a second stage of expansion takes place with snorkel 98 then moving within the cylinder 120 in piston 96 to penetrate the mudcake 49 on the borehole wall 151 and to receive formation fluid.

In one method, as seal pad 140 is pressed against the borehole wall, the pressure in circuit 200 rises and when it reaches a predetermined pressure, the valve 192 opens so as to close the equalizer valve 60, thereby isolating the fluid passageway 93 from the annulus. In this manner, the valve 192 ensures that the valve 60 closes only after the seal pad 140 has entered contact with the mudcake 49 that lines the borehole wall 151. In another method, as the seal pad 140 is pressed against the borehole wall 151, the pressure in circuit 200 rises and closes the equalizer valve 60, thereby isolating the fluid passageway 93 from the annulus. In this manner, the valve 60 may close before the seal pad 140 has entered contact with the mudcake 49 that lines the borehole wall 151. The passageway 93, now closed to the annulus 150, is in fluid communication with the cylinder 175 at the upper end of the cylinder 177 in drawdown manifold 89, best shown in FIG. 3A.

With the solenoid valve 176 still energized, the probe seal accumulator 184 is charged until the system reaches a predetermined pressure, for example 1800 psi, as sensed by the pressure transducer 160*b*. When that pressure is reached, a delay may occur before the controller 190 energizes the solenoid valve 178 to begin drawdown. This delay, which is controllable, can be used to measure properties of the mudcake 49 that lines the borehole wall 151. Energizing the solenoid valve 178 permits pressurized fluid to enter the portion 172*a* of the cylinder 172 causing the drawdown piston 170 to retract. When that occurs, the plunger 174 moves within the cylinder 177 such that the volume of the fluid passageway 93 increases by the volume of the area of the plunger 174 times the length of its stroke along the cylinder 177. This movement increases the volume of cylinder 175, thereby increasing the volume of the fluid passageway 93. For example, the volume of the fluid passageway 93 may be increased by 10 cc as a result of the drawdown piston 170 being retracted.

As the drawdown piston 170 is actuated, formation fluid may thus be drawn through the central passageway 127 of the snorkel 98 and through the screen 100. The movement of the drawdown piston 170 within its cylinder 172 lowers the pressure in the closed passageway 93 to a pressure below the formation pressure, such that formation fluid is drawn through the screen 100 and the snorkel 98 into the aperture 101, then through the stem passageway 108 to the passageway 91 that is in fluid communication with the passageway 93 and part of the same closed fluid system. In total, the fluid chambers 93, which include the volume of various interconnected fluid passageways, including passageways in the probe assembly 50, the passageways 85,93 [FIG. 3], the passageways interconnecting 93 with drawdown piston 170 and the pressure transducers 160*a,c* may have a volume of approximately 40 cc. Drilling mud in the annulus 150 is not drawn into snorkel 98 because pad 140 seals against the mudcake. Snorkel 98 serves as a conduit through which the formation fluid may pass and the pressure of the formation fluid may be measured in passageway 93 while pad 140 serves as a seal to prevent annular fluids from entering the snorkel 98 and invalidating the formation pressure measurement.

Referring momentarily to FIGS. 5 and 6C, formation fluid is drawn first into the central bore 132 of screen 100. It then passes through slots 134 in screen slotted segment 133 such that particles in the fluid are filtered from the flow and are not drawn into passageway 93. The formation fluid then passes between the outer surface of screen 100 and the inner surface of snorkel extension 126 where it next passes through apertures 123 in screen 100 and into the central passageway 108 of stem 92 by passing through apertures 101 and central passage bore 103 of scraper 102.

Referring again to FIG. 10, with seal pad 140 sealed against the borehole wall, check valve 195 maintains the desired pressure acting against piston 96 and snorkel 98 to maintain the proper seal of pad 140. Additionally, because the probe seal accumulator 184 is fully charged, should the tool 10 move during drawdown, additional hydraulic fluid volume may be supplied to the piston 96 and the snorkel 98 to ensure that pad 140 remains tightly sealed against the borehole wall. In addition, should the borehole wall 151 move in the vicinity of pad 140, the probe seal accumulator 184 will supply additional hydraulic fluid volume to piston 96 and snorkel 98 to ensure that pad 140 remains tightly sealed against the borehole wall 151. Without accumulator 184 in circuit 200, movement of the tool 10 or borehole wall 151, and thus of formation probe assembly 50, could result in a loss of seal at pad 140 and a failure of the formation test.

With the drawdown piston 170 in its fully retracted position and formation fluid drawn into closed system 93, the pressure will stabilize and enable pressure transducers 160*a,c* to sense and measure formation fluid pressure. The measured pressure is transmitted to the controller 190 in the electronic section where the information is stored in memory and, alternatively or additionally, is communicated to the master controller in the MWD tool 13 below the formation tester 10 where it can be transmitted to the surface via mud pulse telemetry or by any other conventional telemetry means.

When drawdown is completed, drawdown piston 170 actuates a contact switch 320 mounted in endcap 400 and drawdown piston 170, as shown in FIG. 3A. The drawdown switch assembly consists of contact 300, wire 308 coupled to contact 300, plunger 302, spring 304, ground spring 306, and retainer ring 310. The drawdown piston 170 actuates switch 320 by causing plunger 302 to engage contact 300 that causes wire 308 to couple to system ground via contact 300 to plunger 302 to ground spring 306 to drawdown piston 170 to endcap 400 that is in communication with system ground (not shown).

When the contact switch 320 is actuated controller 190 responds by shutting down motor 64 and pump 66 for energy conservation. Check valve 196 traps the hydraulic pressure and maintains drawdown piston 170 in its retracted position. In the event of any leakage of hydraulic fluid that might allow drawdown piston 170 to begin to move toward its original shouldered position, drawdown accumulator 186 will provide the necessary fluid volume to compensate for any such leakage and thereby maintain sufficient force to retain drawdown piston 170 in its retracted position.

During this interval, controller 190 continuously monitors the pressure in fluid passageway 93 via pressure transducers 160*a,c* until the pressure stabilizes, or after a predetermined time interval.

When the measured pressure stabilizes, or after a predetermined time interval, controller 190 de-energizes solenoid valve 176. De-energizing solenoid valve 176 removes pressure from the close side of equalizer valve 60 and from the extend side of probe piston 96. Spring 58 then returns the equalizer valve 60 to its normally open state and probe retract accumulator 182 will cause piston 96 and snorkel 98 to retract, such that seal pad 140 becomes disengaged with the borehole wall. Thereafter, controller 190 again powers motor 64 to drive pump 66 and again energizes solenoid valve 180. This step ensures that piston 96 and snorkel 98 have fully retracted and that the equalizer valve 60 is opened. Given this arrangement, the formation tool 10 has a redundant probe retract mechanism. Active retract force is provided by the pump 66. A passive retract force is supplied by probe retract accumulator 182 that is capable of retracting the probe even in the event that power is lost. Accumulator 182 may be charged at the surface before being employed downhole to provide pressure to retain the piston and snorkel in housing 12*c*.

Referring again briefly to FIGS. 5 and 6, as piston 96 and snorkel 98 are retracted from their position shown in FIG. 6C to that of FIG. 6B, screen 100 is drawn back into snorkel 98. As this occurs, the flange on the outer edge of scraper 102 drags and thereby scrapes the inner surface of screen member 100. In this manner, material screened from the formation fluid upon its entering of screen 100 and snorkel 98 is removed from screen 100 and deposited into the annulus 150. Similarly, scraper 102 scrapes the inner surface of screen member 100 when snorkel 98 and screen 100 are extended toward the borehole wall.

After a predetermined pressure, for example 1800 psi, is sensed by pressure transducer 160*b* and communicated to controller 190 (indicating that the equalizer valve is open and that the piston and snorkel are fully retracted), controller 190 de-energizes solenoid valve 178 to remove pressure from side 172*a* of drawdown piston 170. With solenoid valve 180 remaining energized, positive pressure is applied to side 172*b* of drawdown piston 170 to ensure that drawdown piston 170 is returned to its original position (as shown in FIG. 3). Controller 190 monitors the pressure via pressure transducer 160*b* and when a predetermined pressure is reached, controller 190 determines that drawdown piston 170 is fully returned and it shuts off motor 64 and pump 66 and de-energizes solenoid valve 180. With all solenoid valves 176, 178, 180 returned to their original position and with motor 64 off, tool 10 is back in its original condition and drilling can again be commenced.

Relief valve 197 protects the hydraulic system 200 from overpressure and pressure transients. Various additional relief valves may be provided. Thermal relief valve 198 protects trapped pressure sections from overpressure. Check valve 199 prevents back flow through the pump 66.

Figure 11:
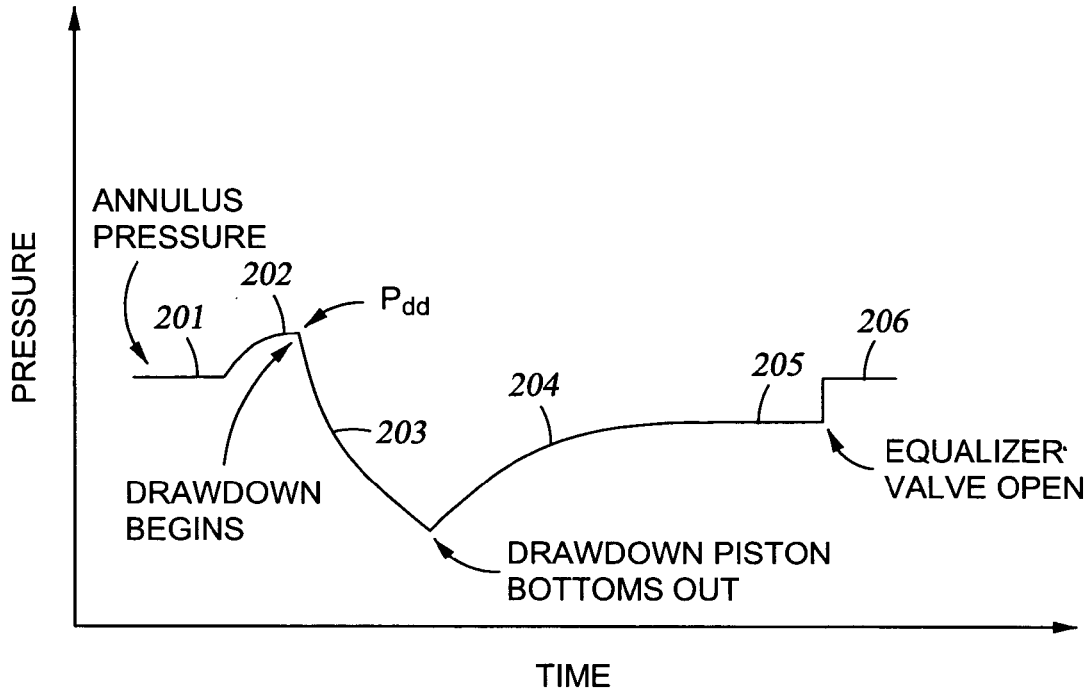
FIG. 11 is a graph of the fluid pressure as compared to time measured during operation of the formation tester.

FIG. 11 illustrates a pressure versus time graph illustrating in a general way the pressure sensed by pressure transducer 160*a,c* during the operation of the formation tester 10. As the formation fluid is drawn within the formation tester 10, pressure readings are taken continuously by the transducers 160*a,c*. The pressure sensed by the transducers 160*a,c* will initially be equal to the annulus, or borehole, pressure shown at point 201. As pad 140 is extended and equalizer valve 60 is closed, there will be a slight increase in pressure as shown at 202. This occurs when the pad 140 seals against the borehole wall 151 and squeezes the drilling fluid trapped in the now-isolated passageway 93. As the drawdown piston 170 is actuated, the volume of the closed passageway 93 increases, causing the pressure to decrease as shown in region 203. When the drawdown piston 170 bottoms out within the cylinder 172, a differential pressure with the formation fluid exists causing the fluid in the formation to move towards the low pressure area and, therefore, causing the pressure to build over time as shown in region 204. The pressure begins to stabilize, and at point 205, achieves the pressure of the formation fluid in the zone being tested. After a fixed time, such as three minutes after the end of region 203, the equalizer valve 60 is again opened, and the pressure within the passageway 93 equalizes back to the annulus pressure as shown at 206.

Referring again to FIG. 10, the formation tester 10 may include four pressure transducers 160: two quartz crystal gauges 160*a,d*, a strain gauge 160*c*, and a differential strain gage 160*b*. One of the quartz crystal gauges 160*a* is in communication with the annulus, or borehole, fluid and also senses formation pressures during the formation test. The other quartz crystal gauge 160*d* is in communication with the flowbore 14 at all times. In addition, both quartz crystal gauges 160*a* and 160*d* may have temperature sensors associated with the crystals. The temperature sensors may be used to compensate the pressure measurement for thermal effects. The temperature sensors may also be used to measure the temperature of the fluids near the pressure transducers. For example, the temperature sensor associated with quartz crystal gauge 160*a* is used to measure the temperature of the fluid near the gage in the passageway 93. The third transducer is a strain gauge 160*c* and is in communication with the annulus fluid and also senses formation pressures during the formation test. The quartz transducers 160*a,d* provide accurate, steady-state pressure information, whereas the strain gauge 160*c* provides faster transient response. In performing the sequencing during the formation test, the passageway 93 is closed off and both the annulus quartz gauge 160*a* and the strain gauge 160*c* measure pressure within the closed passageway 93. The strain gauge transducer 160*c* essentially is used to supplement the quartz gauge 160*a* measurements. When the formation tester 10 is not in use, the quartz transducers 160*a,d* may operatively measure pressure while drilling to serve as a pressure while drilling tool.

Figure 12:
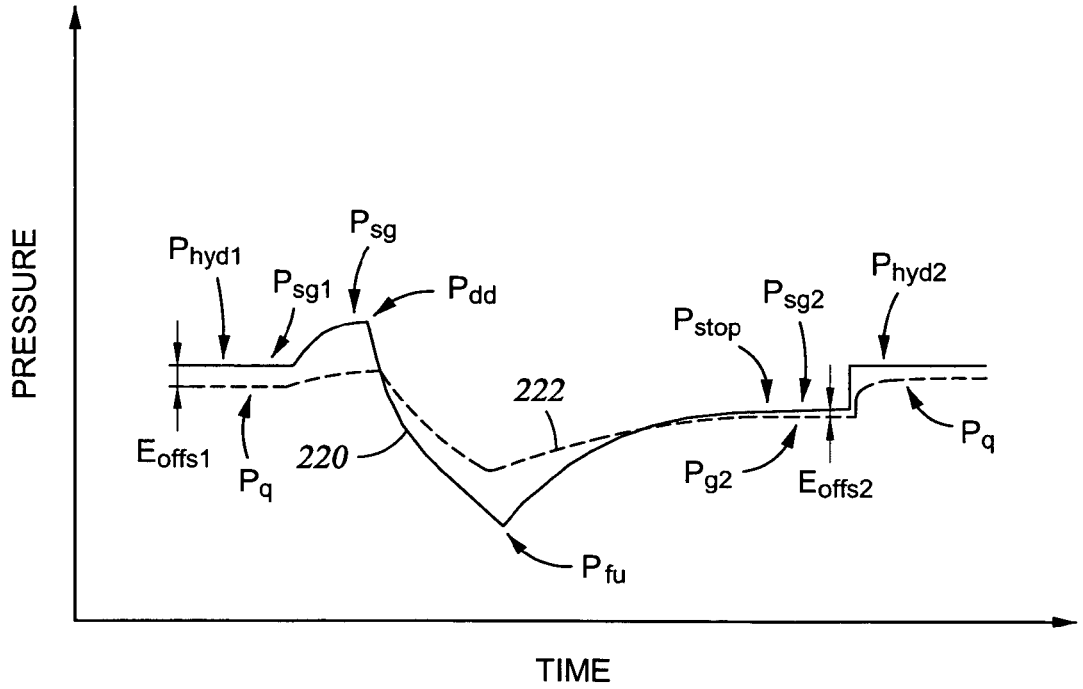
FIG. 12 is another graph of the fluid pressure as compared to time measured during operation of the formation tester and showing pressures measured by different pressure transducers employed in the formation tester.

FIG. 12 illustrates representative formation test pressure curves. The solid curve 220 represents pressure readings $P_{sg}$ detected and transmitted by the strain gauge 160*c*. Similarly, the pressure $P_q$, indicated by the quartz gauge 160*a*, is shown as a dashed line 222. As noted above, strain gauge transducers generally do not offer the accuracy exhibited by quartz transducers and quartz transducers do not provide the transient response offered by strain gauge transducers. Hence, the instantaneous formation test pressures indicated by the strain gauge 160*c* and quartz 160*a* transducers are likely to be different. For example, at the beginning of a formation test, the pressure readings $P_{hydl}$ indicated by the quartz transducer Pq and the strain gauge $P_{sg}$ transducer are different and the difference between these values is indicated as $E_{offs1}$ in FIG. 12.

With the assumption that the quartz gauge reading $P_q$ is the more accurate of the two readings, the actual formation test pressures may be calculated by adding or subtracting the appropriate offset error $E_{offs1}$ to the pressures indicated by the strain gauge $P_{sg}$ for the duration of the formation test. In this manner, the accuracy of the quartz transducer and the transient response of the strain gauge may both be used to generate a corrected formation test pressure that, where desired, is used for real-time calculation of formation characteristics.

As the formation test proceeds, it is possible that the strain gauge readings may become more accurate or for the quartz gauge reading to approach actual pressures in the pressure chamber even though that pressure is changing. In either case, it is probable that the difference between the pressures indicated by the strain gauge transducer and the quartz transducer at a given point in time may change over the duration of the formation test. Hence, it may be desirable to consider a second offset error that is determined at the end of the test where steady state conditions have been resumed. Thus, as pressures $P_{hyd2}$ level off at the end of the formation test, it may be desirable to calculate a second offset error $E_{offs2}$. This second offset error $E_{offs2}$ might then be used to provide an after-the-fact adjustment to the formation test pressures.

The offset values $E_{offs1}$ and $E_{offs2}$ may be used to adjust specific data points in the test. For example, all critical points up to $P_{fu}$ might be adjusted using errors $E_{offs1}$, whereas all remaining points might be adjusted offset using error $E_{offs2}$. Another solution may be to calculate a weighted average between the two offset values and apply this single weighted average offset to all strain gauge pressure readings taken during the formation test. The amplitude of recorded strain gauge data can also be corrected by multiplying by amplitude correction k, where $k=(P_{q1}-P_{q2})/(P_{sg1}-P_{sg2})$. Other methods of applying the offset error values to accurately determine actual formation test pressures may also be used accordingly and will be understood by those skilled in the art.

The formation tester 10 may operate in two general modes: pump-on operation and pump-off operation. During pump on operation, mud pumps on the surface pump drilling fluid through the drill string 6 and back up the annulus 150. Using this column of drilling fluid, the tool 10 can transmit data to the surface using mud pulse telemetry during the formation test. The tool 10 may also receive mud pulse telemetry downlink commands from the surface. During a formation test, the drill string 6 and the formation tester 10 are not rotated. However, it may be the case that an immediate movement or rotation of the drill string 6 will be necessary. As a failsafe feature, at any time during the formation test, an abort command can be transmitted from surface to the formation tester 10. In response to this abort command, the formation tester 10 will immediately discontinue the formation test and retract the probe piston to its normal, retracted position for drilling. The drill string 6 can then be moved or rotated without causing damage to the formation tester 10.

During pump-off operation, a similar failsafe feature may also be active. The formation tester 10 and/or MWD tool 13 may be adapted to sense when the mud flow pumps are turned on. Consequently, the act of turning on the pumps and reestablishing flow through the tool may be sensed by pressure transducer 160*d* or by other pressure sensors in bottom hole assembly 6. This signal will be interpreted by a controller in the MWD tool 13 or other control and communicated to controller 190 that is programmed to automatically trigger an abort command in the formation tester 10. At this point, the formation tester 10 will immediately discontinue the formation test and retract the probe piston 96 to its normal position for drilling. The drill string 6 can then be moved or rotated without causing damage to the formation tester 10.

The uplink and downlink commands are not limited to mud pulse telemetry. By way of example and not by way of limitation, other telemetry systems may include manual methods, including pump cycles, flow/pressure bands, pipe rotation, or combinations thereof. Other possibilities include electromagnetic (EM), acoustic, and wireline telemetry methods. An advantage to using alternative telemetry methods lies in the fact that mud pulse telemetry (both uplink and downlink) requires pump-on operation but other telemetry systems do not. The failsafe abort command may therefore be sent from the surface to the formation tester 10 using an alternative telemetry system regardless of whether the mud flow pumps are on or off.

The down hole receiver for downlink commands or data from the surface may reside within the formation tester 10 or within an MWD tool 13 with which it communicates. Likewise, the down hole transmitter for uplink commands or data from down hole may reside within the formation tester 10 or within an MWD tool 13 with which it communicates. The receivers and transmitters may each be positioned in MWD tool 13 and the receiver signals may be processed, analyzed, and sent to a master controller in the MWD tool 13 before being relayed to local controller 190 in formation testing tool 10.

Commands or data sent from surface to the formation tester 10 can be used for more than transmitting a failsafe abort command. The formation tester 10 can also have many other operating modes that may be selected using a command from the surface. For example, one of a plurality of operating modes may be selected by transmitting a header sequence indicating a change in operating mode followed by a number of pulses that correspond to that operating mode. Other means of selecting an operating mode will certainly be known to those skilled in the art.

In addition to the selection of the operating modes, other information may be transmitted from the surface to the formation tester 10. This information may include critical operational data such as depth or surface drilling mud density. The formation tester 10 may use this information to help refine measurements or calculations made downhole or to select an operating mode. Commands from the surface might also be used to program the formation tester 10 to perform in a mode that is not preprogrammed.

An example of an operating mode of the formation tester 10 is the ability of the formation tester 10 to adapt the pressure test procedure to the bubble point of the formation fluid at different test depths. At discovery, formation fluid can contain some natural gas in solution. The bubble point is the pressure at which the gas comes out of solution in the formation fluid at a given temperature. If any gas comes out of solution during a drawdown test procedure, the test data may not accurately represent the formation pressure.

Figure 13:
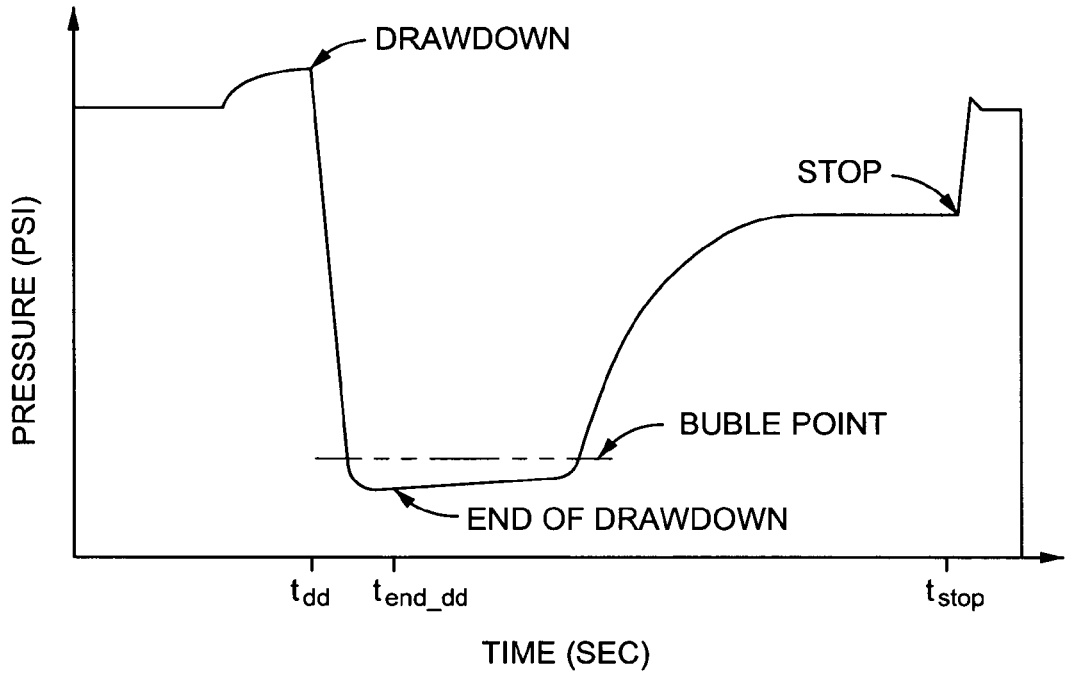
FIG. 13 is another graph of the fluid pressure as compared to time measured during operation of the formation tester that illustrates the bubble point of the fluid in the formation tester being exceeded.

FIG. 13 illustrates a drawdown test procedure where the bubble point of the fluid in the formation tester 10 is exceeded. When the drawdown exceeds the bubble point, the pressure declines rapidly during the drawdown and in low permeability zones the slope is typically directly proportional to the flow rate. This slope is due primarily to the compressibility of the fluid in the flow line of the tool 10. As the drawdown continues, the slope changes when the bubble point is encountered as shown in FIG. 13 at the line marked "Bubble Point". This change in slope can be caused by formation fluids entering the tool 10, but when the pressure does not start to build up after the end of the drawdown ($t_{end_dd}$), then the bubble point has been exceeded. When the bubble point is exceeded, the effective compressibility of the flowline fluid is increased substantially showing the buildup. After a sufficient buildup time some fluid enters the tool 10 from the formation and at some point the gas is absorbed into solution. When this occurs, the compressibility of the flowline fluids is reduced and the buildup rate increases rapidly. Both the inflection point during the drawdown and buildup can be used to estimate the bubble point of the fluid in the tool 10. This can be accomplished by monitoring the slope of the buildup using standard regression techniques. For example, the drawdown stage can be analyzed. Initially the slope is very sharp but changes to nearly 0 when the bubble point is encountered. In this case the initial drawdown curve can be compared to the remaining data and the intersection of these two curves is the bubble point. Starting at the beginning of the drawdown the pressure and time points are monitored. Assuming n points have been collected then the slope is calculated using $n-n_o$ as follows.

$$b = \frac{n\sum xy - (\sum x)(\sum y)}{n\sum x^2 - (\sum x)^2}$$

buildup slope in psi/sec $a=(\Sigma y-b\Sigma x)/n$ line intercept using $n-n_o$ points Where: $x_i$—time $y_i$—pressure n—start of drawdown points collected (usually 8–20 data points).

Using the last 10–20 data points a second slope is monitored to look for a change in slope.

$$b_o = \frac{n_o\sum xy - (\sum x)(\sum y)}{n_o\sum x^2 - (\sum x)^2}$$

end of drawdown and beginning of buildup slope $a_o=(\Sigma y-b_o\Sigma x)/n_o$ line intercept using $n_o$ points Where: $n_o$—set number of points (usually 30 to 120 points).

The beginning slope b is much larger than the ending slope $b_o$ and the bubble point is determined by the intersection of the two lines.

$$P_{bp} = y_{bp} = \frac{a_o b - a b_o}{b - b_o}$$

If the buildup is allowed to continue another estimate of bubble point can be made from the buildup data. Using this technique, all of the buildup data can be used to determine b and then only a portion of the buildup data is monitored to determine the current slope $b_o$. While monitoring these slopes during the buildup, the ending slope $b_o$ becomes much greater than the predominate slope b. The bubble point is then estimated by the intersection of the two lines. The time at which the intersection occurs can also be used to estimate formation permeability.

$$t_{bp} = x_{bp} = \frac{a_o - a}{b - b_o}$$

The linear regression techniques shown are one of several methods that can be used to determine curve inflection points and the subsequent bubble points. Derivative and second derivatives and non linear regression methods may also be used.

The bubble point determined from the buildup is typically higher than that determined from the drawdown (see FIG. 13). This is due to the thermodynamic changes that occur during the rapid drawdown and then the slow buildup. Typically the fluid is cooled due to adiabatic expansion during the drawdown. This cooling effect tends cause the bubble point to be underestimated. During the buildup the temperature equalizes and the apparent bubble point also increases.

In the case where the bubble point and time is determined from the buildup curve, the formation mobility can be estimated by making a few assumptions. The first is that the actual formation flow rate is much lower than the pretest piston rate measured by the formation tester 10. This is because the gas formation in the tool is now regulating the rate. If it is assumed that the flow rate is nearly constant during the time where the pretest starts and where the phase change occurs during the buildup, then the formation spherical mobility can be estimated as follows.

$$Ms = \left(\frac{14,696}{2\pi}\right)\left(\frac{q_o}{\Delta P_{dd}}\right)\left(\frac{C_{dd}}{r_s}\right)$$

Where: $q_o = V_0/(t_{bp} - t_{dd_start})$ estimated drawdown flow rate (cc/sec)

$V_o$=drawdown volume (cc)

$t_{bp}$=bubble point buildup time (sec)

$t_{dd_start}$=start of drawdown (sec)

$r_s$=snorkel radius(cm)

$C_{dd}$=flow correction factor (dimensionless)

$\Delta P_{dd} = P_{stop} - P_{bp}$

The second assumption is that the formation pressure is near the last build pressure $P_{stop}$. If there is insufficient time for the buildup to stabilize, $P_{Stop}$ may not yield an optimistic estimate of Ms. If this is the case the hydrostatic mud pressure can be used to obtain a conservative estimate of Ms. This technique of determining the mobility is called the drawdown method and assumes steady state flow. This is one of several that can be used to estimate the mobility. Other methods could include spherical homer and derivative plots.

The operating mode of the formation tester 10 may be adjusted to account for the bubble point of the formation fluid. For example, if the bubble point is breached, the drawdown piston 170 may be moved back to the starting position and the pressure test performed over again.

The first method of modifying the pretest is to lower the flow rate of the fluid into the tool 10. This is accomplished by estimating a flow rate that would keep the drawdown pressure above the bubble point. This can be done from the estimate of the spherical mobility Ms as follows:

$$q_{pt} = Ms\Delta P_{dd}\left(\frac{r_s}{C_{dd}}\right)\left(\frac{2\pi}{14,696}\right)$$

After the pressure has been equalized back to nearly hydrostatic the second pretest is performed at the new rate.

Still another method of performing the second drawdown is to set a cutoff pressure. The pretest would stop as soon as this pressure is reached. The cutoff pressure would be higher than the estimated bubble point pressure, usually by several hundred psi. Again the second pretest would be performed after the flowline pressure has been equalized back to nearly hydrostatic mud pressure. This second pretest would start at the same rate as the first but then the pretest piston displacement is stopped when the pressure reaches the cutoff pressure.

Still another method is to both adjust the flow rate and set a cutoff pressure. It may not be possible for the formation tester 10 to reduce its rate to that required to maintain the pressure above the bubble point. The slower rate reduces the change in pressure over time and makes stopping the pretest piston at the prescribe cutoff pressure more accurate.

As another example, if the test is allowed sufficient time to build up as illustrated in FIG. 13. The pressure is allowed to build up and the gas allowed to recombine with the fluids from the formation. The amount of time for the gas to recombine may depend on the bubble point pressure and the characteristics of the test fluid. From this information, the formation permeability can be estimated and the drawdown rate can be adjusted so that the drawdown pressure would not fall below the bubble point.

Alternatively, the drawdown of the drawdown piston 170 may be done incrementally until a proper drawdown and buildup are achieved. Using this method, the drawdown piston 170 is drawn down, but not to the full extent under a normal pressure test. The pressure is then monitored in the cylinder 175 using the transducers 160. If the drawdown piston 170 was not drawn down enough to produce a proper buildup, the drawdown piston 170 is drawn down again to create more of a pressure drop within the cylinder 175. The drawdown may be adjusted by drawing the drawdown piston 170 more or at a faster rate, or a combination of magnitude and rate. This method may be performed until a proper drawdown and build up are achieved. Although the bubble point pressure is not measured, parameters for the pressure test may be set based on the incremental drawdown steps to ensure that the bubble point is not reached with further pressure tests.

Other operating modes involve the formation tester 10 determining the bubble point of the formation fluid by performing a pressure test to purposefully bubble point the formation fluid. During the pressure test, the flowline valve 179 may be closed and the drawdown piston 170 drawn down to lower the pressure in the cylinder 175 and create a known volume within the cylinder 175. Once the drawdown piston 170 is retracted, the flowline valve 179 may be opened. With enough pressure drop, the formation fluid will breach its bubble point and any gas in the formation fluid will come out of solution. If the bubble point is not breached, then the test is repeated until enough of an initial pressure drop is created to breach the bubble point. Normally the pretest is moved at it slowest rate while monitoring pressure of the sealed flowline. Then the method of determining the bubble point would be similar to that shown earlier for a pretest drawdown. Basically linear regressions can be used to determine when a slope change occurs. Alternatively the first or second derivative as well as nonlinear regression methods can be used to determine the bubble point. It is also desirable to measure the piston displacement to more accurately monitor the actual rate and volume change. Alternatively the volume change over the total initial trapped volume can be plotted against pressure to improve the bubble point estimate and determine fluid compressibility.

To measure the bubble point pressure from the test, the formation tester 10 may use the position of the drawdown piston 170 as the drawdown piston 170 retracts during the drawdown portion of the pressure test. Knowing the position of the drawdown piston 170, the volume of the cylinder 175 at all positions of drawdown piston 170 may then be calculated. One method to determine position of the drawdown piston 170 is to measure the amount of hydraulic fluid used to drawdown the drawdown piston 170, the time, and the flowrate of the hydraulic fluid pumped by the hydraulic pump 66. Then, knowing the surface area of the face of the drawdown piston 170 facing the flowline side 172*a* of the cylinder 172, the position of the drawdown piston 1.70 may be calculated. The displacement distance of the drawdown piston 170 is the change in volume of the hydraulic fluid divided by the surface area of the drawdown piston 170 facing the flowline side 172*a*. The change in volume is calculated by multiplying the amount of time by the flowrate of the hydraulic fluid. Another method of determining position is using a position indicator such as an acoustic sensor, an optical sensor, a linear variable displacement transducer, a potentiometer, a Hall Effect sensor, or any other suitable position indicator or any other suitable method of determining position of the drawdown piston 170.

The pressure at which the formation fluid reaches the bubble point can be calculated during the pressure test manually or by using the controller 190. The controller 190 continuously records elapsed time and the formation fluid pressure during the pre-test. The controller 190 can also calculate the volume of the formation fluid in the cylinder 175 by using the elapsed time, hydraulic pump rate, and the position information of the drawdown piston 170 by the following relationship:

$$\text{Formation Fluid Volume} = \frac{(Area_{dd})(\text{Hydraulic Pump Rate})(\text{Time})}{(Area_{hyd})}$$

Where $Area_{dd}$ is the area of the drawdown piston 170 on the flow line side 172*a* and $Area_{hyd}$ is the area of drawdown piston 170 on the hydraulic oil side 172*b*. The master controller 190 can continuously calculate the compressibility of the fluid in the flow line 93, where compressibility is the ratio of the formation fluid pressure to the formation fluid volume. The bubble point may be the pressure where these calculated ratios change.

Figure 14:
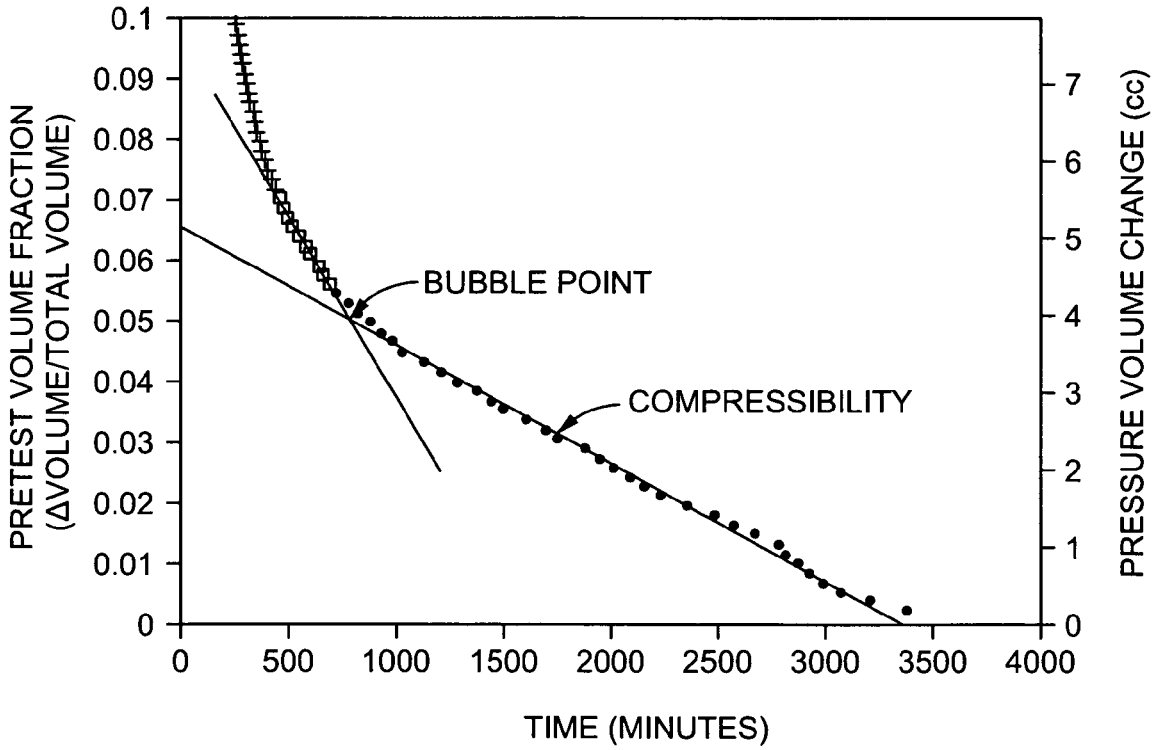
FIG. 14 is a graph that shows an example of compressibility and bubble point determination.

An example of compressibility and bubble point determination is illustrated in FIG. 14, where volume change over the initial volume is plotted against pressure. The straight line portion is used to determine the fluid compressibility and the bubble point is determined with the pressure curve deviates from the straight line. The bubble point can be determined by the curve fitting methods previously discussed.

Once the bubble point pressure of the formation fluid has been determined, the operating mode of the formation tester 10 may be adjusted so as to stay above the bubble point and keep the gas in solution in the formation fluid during the pressure test.

For example, the formation tester 10 may variably control the drawdown volume created in the cylinder 175 during the pressure test. The most effective method of controlling the drawdown volume is by using the cutoff pressure discussed previously. It is normally desirable to also slow the rate to improve the cutoff pressure methods accuracy.

Alternatively, formation tester 10 may variably control the drawdown rate of the drawdown piston 170 so as to stay above the bubble point pressure. As discussed previously if the formation spherical mobility can be estimated then a rate can be calculated that would keep the drawdown pressure above the bubble point.

Also alternatively, the formation tester 10 may variably control both the drawdown volume and the drawdown rate of the drawdown piston 170 as discussed above.

The formation tester 10 may variably control the drawdown of the drawdown piston 170 to maintain a certain pressure within the cylinder 175 manually or automatically. When done manually, the measured pressure information from the pressure test is recorded and/or sent to the surface where it is monitored and analyzed. Using the calculated bubble point information, commands may be sent to the formation tester 10 to vary the drawdown procedure and avoid the bubble point for the next pressure test as discussed previously. When done automatically, the pressure test information is sent to the controller 190 for analysis of the bubble point. The controller 190 then automatically adjusts the drawdown volume and/or rate of the drawdown piston 170 for the next drawdown procedure to avoid breaching the bubble point as discussed above.

Another mode of operation involves the consistency of the drawdown rate of the drawdown piston 170 during a pressure test. Typically, the formation tester 10 does not change the drawdown rate of the drawdown piston 170 during a pressure test. However, the controller 190 may change the drawdown rate of the drawdown piston 170 during a drawdown by controlling the hydraulic pump 66. Regardless, when being drawn down, the drawdown piston 170 should maintain a substantially constant drawdown rate until the controller 190 adjusts the drawdown rate. Although the positional information of the drawdown piston 170 during drawdown may be taken into account in any pressure test calculations, not maintaining the drawdown rate of the piston 170 constant may affect the accuracy of pressure test measurements and calculations. Maintaining a constant drawdown rate may be difficult to achieve, however, due to the start-up, shut-down, or otherwise inconsistent output of the electric motor 64 and hydraulic pump 66, as well as other system factors.

To maintain the drawdown rate of the drawdown piston 170 substantially constant, the formation tester 10 may send the drawdown piston 170 positional information to the controller 190. The controller 190 uses the positional information to calculate the drawdown rate of the piston 170. Based on the calculations, the controller determines if adjustments need to be made in the hydraulic system 200 during the drawdown of the drawdown piston 170 to maintain a substantially constant drawdown rate.

Figure 15:
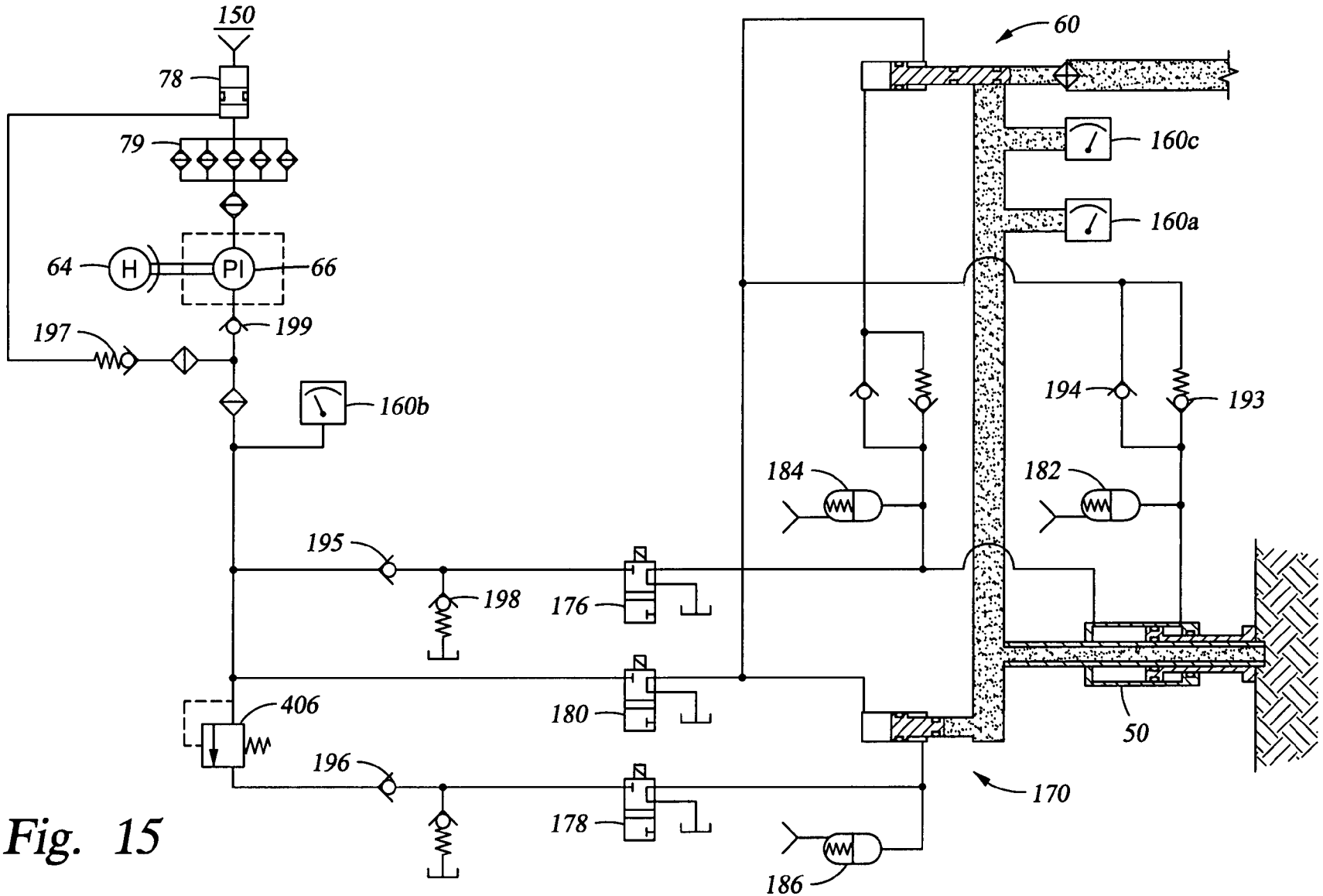
FIG. 15 is a schematic view of a hydraulic circuit employed in operating the formation tester using a hydraulic threshold.

FIG. 15 illustrates another method of maintaining a substantially constant drawdown rate using a hydraulic threshold 406, for example a sequencing valve, downstream of the hydraulic pump 66. The hydraulic threshold 406 requires that a certain hydraulic pressure be achieved by the electric motor 64 and hydraulic pump 66 before the hydraulic fluid is allowed to pass through the hydraulic threshold 406. For example, the minimum hydraulic pressure might be 2500 psi above the borehole pressure. Thus, the hydraulic threshold 406 acts to allow the pressure to build up before the pressure is allowed to act on the drawdown piston 170. Then, if the same hydraulic load is maintained on the hydraulic pump 66, the displacement for a given depth and for a given set of environmental conditions will be constant and the drawdown rate of the drawdown piston 170 will be substantially constant.

Figure 16:
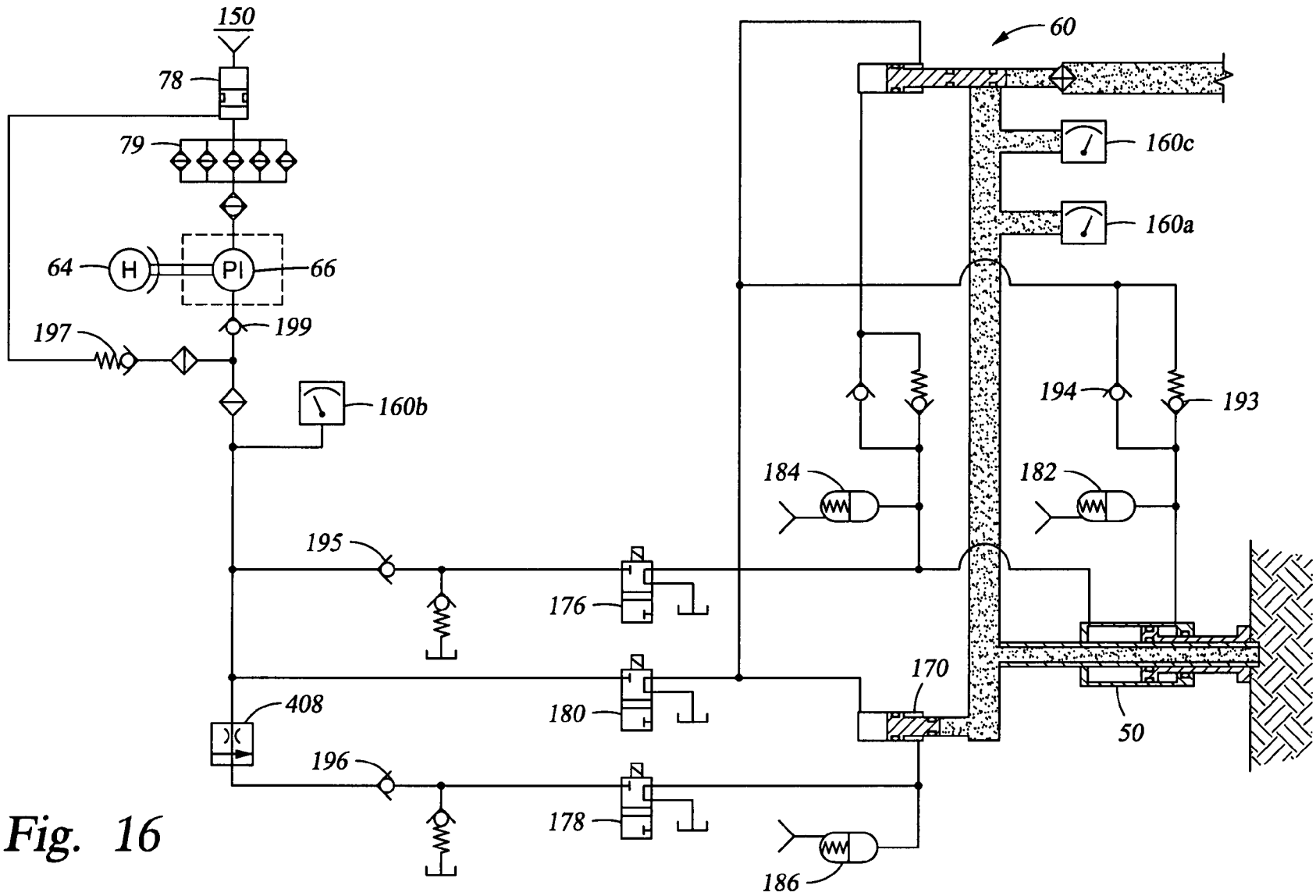
FIG. 16 is a schematic view of a hydraulic circuit employed in operating the formation tester using a pressure compensated variable restrictor.

FIG. 16 illustrates another method of maintaining a steady drawdown rate with a pressure compensated variable restrictor 408 in the hydraulic flowline 93 downstream of the hydraulic pump 66. The variable restrictor 408 maintains a constant hydraulic flowrate independent of the required hydraulic load. Therefore, the drawdown piston 170 is able to drawdown at a constant rate independent of the actual drawdown pressure achieved within flowline 93.

Figure 17:
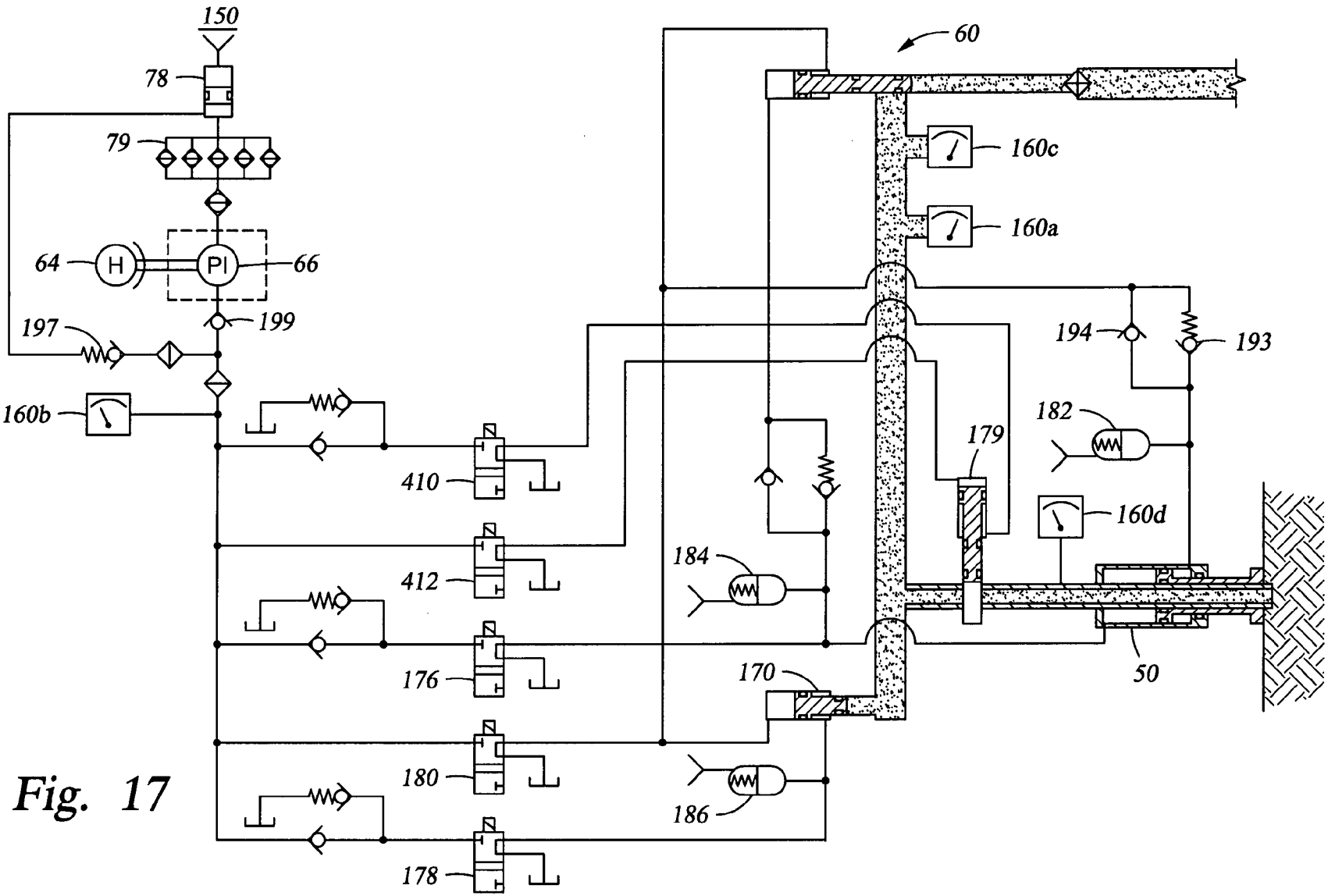
FIG. 17 is a schematic view of a hydraulic circuit employed in operating the formation tester that allows the formation tester to perform a burst test.

FIG. 17 illustrates another operating mode that allows the formation tester 10 to perform a burst test. The burst test may be performed when the drawdown piston 170 cannot drawdown fast enough to create a sufficient pressure drop for the pressure test. To perform the burst test, the formation tester 10 closes the flowline valve 179 to isolate the cylinder 175 from the pad 140. The drawdown piston 170 is then drawn down to create a pressure drop within the cylinder 175 and flowline 93 behind the flowline valve 179. The flowline valve 179 is then opened to create a pressure drop in the pad 140 side of the flowline 93 that is large enough to get sufficient drawdown for the pressure test. The flowline valve 179 is closed by actuating solenoid valve 412, which directs pressurized hydraulic fluid from the pump 66 to the actuator of valve 179. While the flowline valve 179 is closed, the pressure of the flowline upstream of the flowline valve 179 (pad side) may be monitored by the pressure transducer 160*d*. The flowline valve 179 may be opened by de-actuating solenoid valve 412 and actuating solenoid valve 410. The burst test thus allows the formation tester 10 to create a larger pressure drop than if the drawdown piston 170 were drawn down in a typical pressure test due to the creation of the pressure drop before the formation fluid enters the cylinder 175.

Another operating mode allows the formation tester 10 to make adjustments during the pressure test relating to the seal formed by seal pad 140 of formation probe assembly 50 against the borehole wall 151 or the mudcake 49. As mentioned above, the operating environment of the borehole 8 can change during the pressure test with either a change in pressure or a deterioration of the borehole wall 151. The electric motor 64, hydraulic pump 66, hydraulic manifold 62, equalizer valve 60, formation probe assembly 50, or any other parts of hydraulic system 200 may also affect the ability to maintain a proper seal against the mudcake 49 or borehole wall 151.

The formation tester 10 makes adjustments by monitoring the integrity of the seal of the pad 140 using the pressure transducers 160*a–d*. The formation tester 10 uses the transducer data to make adjustments manually using data sent back and forth between the surface and the controller 190 or automatically by sending the monitored information to the controller 190 for analysis. For example, if the monitored pressure approaches the previously measured borehole pressure, then the seal may have been formed improperly. If an improper seal was made, the controller 190 may retract the pad 140 and re-initiate the pressure test. Alternatively, a leak may occur during the pressure test causing the pad 140 to seal improperly. If the seal deteriorates, the formation tester 10 may make adjustments to the hydraulic system 200 to vary the pad force against the mudcake 149 or borehole wall 151. For example, the controller 190 may increase the hydraulic pressure to exert more force by the pad 140 against the mudcake 49 or the borehole wall 151. Additionally, even if the formation tester 10 makes any adjustments automatically, then the tool 10 may send information regarding the adjustments to the surface as well as information regarding the amount of additional time needed to properly run the pressure test.

Alternatively, the formation tester 10 may comprise a sequencing valve, similar to the valve 192 discussed above, that requires a minimum pressure on the pad 140 to create force against the mudcake 49 or the borehole wall 151 before the pressure test may be performed. Although the amount of pressure may not guarantee a good seal, the sequencing valve ensures that a designated minimum pressure be placed on the pad 140 before the pressure test may be performed.

The controller 190 may also be used to vary any one of the pressure test parameters to experiment with and optimize the testing procedures. For example, the buildup, drawdown rate, drawdown volume, pad load, or any other parameter may be varied to observe the changes, if any, to the results of the formation pressure test. The results may then be analyzed by the controller 190 and the testing procedures changed to obtain more precise formation pressure measurements.

While specific embodiments have been illustrated and described, one skilled in the art can make modifications without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method of testing a downhole formation comprising:
disposing a formation tester on a drill string in a borehole;
performing a formation test procedure with said formation tester comprising:
forming a seal between a formation probe assembly of said formation tester and the formation;
drawing down a drawdown piston within a chamber in said formation tester to create a volume within said chamber;
drawing formation fluid into said volume in said chamber; and
monitoring the pressure within said chamber;
determining if the pressure within said chamber is less than the bubble point pressure of the formation fluid drawn into said chamber;
maintaining the position of said drawdown piston until escaped formation fluid gas recombines into solution with the formation fluid in said chamber; and
continuing drawing down said drawdown piston.

2. The method of claim 1 wherein adjusting said formation test procedure comprises:
transmitting formation test procedure data from said formation tester to the surface;
transmitting formation test procedure commands from the surface to a controller in said formation tester; and
adjusting said formation test procedure with said controller.

3. The method of claim 1 wherein adjusting said formation test procedure comprises:
transmitting formation test procedure data to a controller in said formation tester;
analyzing said formation test procedure data with said controller; and
adjusting said formation test procedure with said controller.

4. The method of claim 1 wherein monitoring the pressure within said chamber comprises using a pressure transducer.

5. A method of testing a downhole formation comprising:
disposing a formation tester on a drill string in a borehole;
performing a formation test procedure with said formation tester comprising:
forming a seal between a formation probe assembly of said formation tester and the formation;
drawing down a drawdown piston within a chamber in said formation tester to create a volume within said chamber;
drawing formation fluid into said volume in said chamber; and
monitoring the pressure within said chamber;
determining if the pressure within said chamber is less than the bubble point pressure of the formation fluid drawn into said chamber;
resetting said drawdown piston;
performing said formation test procedure with a decreased amount of volume created by drawing down said drawdown piston.

6. A method of testing a downhole formation comprising:
disposing a formation tester on a drill string in a borehole;
performing a formation test procedure with said formation tester comprising:
forming a seal between a formation probe assembly of said formation tester and the formation;
drawing down a drawdown piston within a chamber in said formation tester to create a volume within said chamber;

drawing formation fluid into said volume in said chamber; and monitoring the pressure within said chamber;

determining if the pressure within said chamber is less than the bubble point pressure of the formation fluid drawn into said chamber;

resetting said drawdown piston;

re-performing said formation test procedure while monitoring the position of said drawdown piston;

determining the amount of volume created by drawing down said drawdown piston;

determining the bubble point of the formation fluid;

resetting said drawdown piston; and re-performing said formation test procedure comprising maintaining the pressure within said chamber above the bubble point pressure of the formation fluid while drawing down said drawdown piston.

7. The method of claim 6 wherein maintaining the pressure within said chamber above the bubble point pressure of the formation fluid comprises decreasing the amount of volume created by said drawdown piston.

8. The method of claim 6 wherein maintaining the pressure within said chamber above the bubble point pressure of the formation fluid comprises decreasing the draw down rate of said drawdown piston.

9. The method of claim 6 wherein maintaining the pressure within said chamber above the bubble point pressure of the formation fluid comprises decreasing the amount of volume created by said drawdown piston and decreasing the draw down rate of said drawdown piston.

10. The method of claim 6 wherein maintaining the pressure within said chamber above the bubble point pressure of the formation fluid comprises variably controlling the amount of volume created by said drawdown piston while drawing down said drawdown piston.

11. The method of claim 6 wherein maintaining the pressure within said chamber above the bubble point pressure of the formation fluid comprises variably controlling the draw down rate of said drawdown piston while drawing down said drawdown piston.

12. The method of claim 6 wherein maintaining the pressure within said chamber above the bubble point pressure of the formation fluid comprises variably controlling the amount of volume created by said drawdown piston and the draw down rate of said drawdown piston while drawing down said drawdown piston.

13. A method of testing a downhole formation comprising:

disposing a formation tester on a drill string in a borehole;

performing a formation test procedure with said formation tester comprising:

forming a seal between a formation probe assembly of said formation tester and the formation;

drawing down a drawdown piston within a chamber in said formation tester to create a volume within said chamber;

drawing formation fluid into said volume in said chamber; and monitoring the pressure within said chamber;

monitoring the position of said drawdown piston during said formation test procedure; and variably controlling the drawdown of said drawdown piston during a drawdown to maintain a substantially constant drawdown rate.

14. The method of claim 13 further comprising:

monitoring the position of said drawdown piston with a controller in said formation tester;

analyzing the position of said drawdown piston with said controller during the drawing down of said drawdown piston; and controlling said formation test procedure with said controller.

15. A method of testing a downhole formation comprising:

disposing a formation tester on a drill string in a borehole;

performing a formation test procedure with said formation tester comprising:

forming a seal between a formation probe assembly of said formation tester and the formation;

drawing down a drawdown piston within a chamber in said formation tester to create a volume within said chamber;

drawing formation fluid into said volume in said chamber; and monitoring the pressure within said chamber;

resetting said drawdown piston;

creating a pressure drop in said chamber by isolating said chamber from the formation fluid and drawing down said drawdown piston to create a volume within said chamber;

allowing the formation fluid to communicate with the volume in said chamber; and drawing formation fluid into the volume in said chamber.

16. The method of claim 15 wherein isolating said chamber comprises controlling a flowline valve between said formation probe assembly and said cylinder with a controller.

17. A method of testing a downhole formation comprising:

disposing a formation tester on a drill string in a borehole;

initiating a formation test procedure with said formation tester comprising:

extending a formation probe assembly of said formation tester into engagement with the formation;

drawing down a drawdown piston within a chamber in said formation tester to create a volume within said chamber;

drawing formation fluid into said volume in said chamber; and monitoring the pressure within said chamber;

monitoring the pressure in the borehole;

transmitting the borehole and chamber pressure data from downhole to the surface;

determining if the pressure in said chamber is substantially equal to the pressure in the borehole during the drawdown;

transmitting formation test procedure commands from the surface to a controller in said formation tester;

aborting said formation test procedure using said controller to retract said formation probe assembly and reset said drawdown piston before said test procedure is complete; and re-performing said formation test procedure.

18. A method of testing a downhole formation comprising:

disposing a formation tester on a drill string in a borehole;

initiating a formation test procedure with said formation tester comprising:

extending a formation probe assembly of said formation tester into engagement with the formation;

drawing down a drawdown piston within a chamber in said formation tester to create a volume within said chamber;

drawing formation fluid into said volume in said chamber; and monitoring the pressure within said chamber;

monitoring the pressure in the borehole;

transmitting the borehole and chamber pressure data to a controller in said formation tester;

analyzing said data with said controller to determine if the pressure in said chamber is substantially equal to the pressure in the borehole;

aborting said formation test procedure by using said controller to retract said formation probe assembly and reset said drawdown piston; and re-performing said formation test procedure.

19. A method of testing a downhole formation comprising:

disposing a formation tester on a drill string in a borehole;

performing a formation test procedure with said formation tester comprising:

forming a seal between a formation probe assembly of said formation tester and the formation;

drawing down a drawdown piston within a chamber in said formation tester to create a volume within said chamber;

drawing formation fluid into said volume in said chamber; and monitoring the pressure within said chamber;

monitoring the pressure in the borehole;

transmitting the borehole and chamber pressure data from downhole to the surface;

determining if the seal formed by said formation probe assembly is deteriorating;

transmitting formation test procedure commands from the surface to a controller in said formation tester; and increasing the force of the formation probe assembly against the formation.

20. The method of claim 19 wherein increasing the force of the formation probe assembly against the formation comprises said controller increasing hydraulic pressure in a hydraulic flowline used to extend said formation probe assembly.

21. A method of testing a downhole formation comprising:

disposing a formation tester on a drill string in a borehole;

performing a formation test procedure with said formation tester comprising:

forming a seal between a formation probe assembly of said formation tester and the formation;

drawing down a drawdown piston within a chamber in said formation tester to create a volume within said chamber;

drawing formation fluid into said volume in said chamber; and monitoring the pressure within said chamber;

monitoring the pressure in the borehole;

transmitting the borehole and chamber pressure data to a controller in said formation tester;

analyzing said data with said controller to determine if the seal formed by said formation probe assembly is deteriorating;

transmitting commands from said controller to increase the force of the formation probe assembly against the formation; and increasing the force of the formation probe assembly against the formation.

22. The method of claim 21 wherein increasing the force of the formation probe assembly against the formation comprises increasing the hydraulic pressure in a hydraulic flowline used to extend said formation probe assembly.

23. A method of testing a down hole formation comprising:

disposing a formation tester on a drill string in a borehole;

performing a formation test procedure with said formation tester comprising:

forming a seal between a formation probe assembly of said formation tester and the formation;

operating a hydraulic pump to create hydraulic pressure;

isolating a drawdown piston from said hydraulic pressure;

communicating said hydraulic pressure to said drawdown piston once a minimum hydraulic pressure is produced by said hydraulic pump;

drawing down said drawdown piston at a substantially constant drawdown rate with said hydraulic pressure;

creating a volume within a chamber within said formation tester by drawing down said drawdown piston;

drawing formation fluid into said volume in said cylinder; and monitoring the pressure within said cylinder.

24. The method of claim 23 further comprising isolating said drawdown piston from the hydraulic pressure with a sequencing valve.

25. A method of testing a down hole formation comprising:

disposing a formation tester on a drill string in a borehole;

performing a formation test procedure with said formation tester comprising:

forming a seal between a formation probe assembly of said formation tester and the formation;

operating a hydraulic pump to create hydraulic pressure;

controlling the amount of hydraulic pressure communicated to a drawdown piston to be less than the amount of hydraulic pressure produced by said hydraulic pump;

drawing down said drawdown piston at a substantially constant drawdown rate with the hydraulic pressure;

creating a volume within a chamber within said formation tester by drawing down said drawdown piston;

drawing formation fluid into the volume in said chamber; and monitoring the pressure within said chamber.

26. The method of claim 25 further comprising controlling the amount of hydraulic pressure communicated to said drawdown piston with a choke.

* * * * *